US008973916B2

(12) United States Patent
Takada

(10) Patent No.: US 8,973,916 B2
(45) Date of Patent: Mar. 10, 2015

(54) MEDIUM ACCUMULATING DEVICE WITH ACCUMULATION TABLE DETECTOR

(75) Inventor: Atsushi Takada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/807,911

(22) PCT Filed: May 31, 2011

(86) PCT No.: PCT/JP2011/062503

§ 371 (c)(1),
(2), (4) Date: Dec. 31, 2012

(87) PCT Pub. No.: WO2012/026178

PCT Pub. Date: Mar. 1, 2012

(65) Prior Publication Data

US 2013/0099442 A1 Apr. 25, 2013

(30) Foreign Application Priority Data

Aug. 26, 2010 (JP) ..... 2010-189233

(51) Int. Cl.

*B65H 31/14* (2006.01)
*B65H 43/02* (2006.01)
*G07D 11/00* (2006.01)

(52) U.S. Cl.

CPC ..... *B65H 31/14* (2013.01); *B65H 43/02* (2013.01); *G07D 11/0036* (2013.01); *B65H 2511/20* (2013.01); *B65H 2553/41* (2013.01); *B65H 2553/412* (2013.01); *B65H 2553/414* (2013.01); *B65H 2553/44* (2013.01); *B65H 2701/1912* (2013.01)

USPC ... 271/219; 271/217; 250/559.4; 250/559.13; 250/559.15

(58) Field of Classification Search

CPC ..... B65H 31/10; B65H 31/14; B65H 43/02; B65H 2220/03; B65H 2220/09; B65H 2301/324; B65H 2301/42264; B65H 2553/44; B65H 2553/822; B65H 2402/543; G07D 11/0045

USPC ..... 271/217, 219; 250/559.13, 559.15, 250/559.4

See application file for complete search history.

(56) References Cited

U.S. PATENT DOCUMENTS

| | | | | |
|---|---|---|---|---|
| 6,145,826 | A * | 11/2000 | Kawata | 271/217 |
| 6,848,688 | B1 | 2/2005 | Ruthenberg et al. | |
| 7,677,545 | B2 | 3/2010 | Iwami et al. | |
| 7,690,637 | B2 | 4/2010 | Yamamoto | |

FOREIGN PATENT DOCUMENTS

| | | | |
|---|---|---|---|
| CN | 1623878 | A | 6/2005 |
| CN | 1778658 | A | 5/2006 |
| CN | 101234714 | A | 8/2008 |
| CN | 101238056 | A | 8/2008 |
| CN | 101266703 | A | 9/2008 |

(Continued)

*Primary Examiner* — Gerald McClain
(74) *Attorney, Agent, or Firm* — Rabin & Berdo, P.C.

(57) ABSTRACT

A medium accumulating device has an accumulation table on which a medium is accumulated, an elastic member that supports the accumulation table, and an accumulation table detector that detects lowering of the accumulation table. The accumulation table is sensed to determine whether the accumulation table lowers below a predetermined position to thereby determine whether or not a medium is accumulated on the accumulation table.

16 Claims, 22 Drawing Sheets

(56) References Cited

FOREIGN PATENT DOCUMENTS

| | | | | |
|---|---|---|---|---|
| CN | 101734508 | A | | 6/2010 |
| EP | 1 415 942 | A2 | | 5/2004 |
| JP | 2-144383 | | | 6/1990 |
| JP | 3-105160 | U1 | * | 10/1991 |
| JP | 105160/1991 | U | | 10/1991 |
| JP | 6-100205 | | | 4/1994 |
| JP | 2000-16668 | | | 1/2000 |
| JP | 2001-335236 | A | | 12/2001 |
| JP | 2005-015123 | A | | 1/2005 |
| JP | 2006-1736 | | | 1/2006 |
| JP | 2006004039 | A | * | 1/2006 |
| JP | 2009-102096 | A | | 5/2009 |
| JP | 4446806 | | | 1/2010 |
| JP | 2010-122983 | | | 6/2010 |
| JP | 2010-128536 | A | | 6/2010 |
| RU | 2 175 210 | C2 | | 10/2001 |
| RU | 2 366 789 | C1 | | 9/2009 |

* cited by examiner

| | | BILL SENSOR 38 | |
|---|---|---|---|
| | | BRIGHT | DARK |
| ACCUMULATION TABLE SENSOR 37 | BRIGHT | BILL EXISTING | BILL EXISTING |
| | DARK | NO BILL | BILL EXISTING |

MEDIUM ACCUMULATING DEVICE WITH ACCUMULATION TABLE DETECTOR

TECHNICAL FIELD

The present invention relates to a medium accumulating device and, for example, a medium accumulating device advantageously applied to automatic transaction devices disposed in financial facilities.

BACKGROUND ART

In recent years, automatic transaction devices typified by automated teller machines (ATM) in financial facilities have been installed in various sites such as banks, station premises and convenience stores. Customers can make various operations on the display screen displayed on an automatic transaction device under a variety of situations to make transactions including making money deposit and withdraw and inquiring balances.

Such an automatic transaction device is provided with a bill storing/discharging depository that stores and discharges bills. A bill accumulating mechanism in the conventional bill storing/discharging depository is generally provided with a transfer path such that bills are transferred onto a bill accumulation table in the horizontal direction. The bills transferred over the transfer path in the horizontal direction are vertically accumulated on the bill accumulation table in the horizontal position thereof.

Japanese Patent Laid-Open Publication No. 2010-128536 proposes a bill accumulating mechanism in which a bill accumulation table has an inclined surface provided, on which bills will be accumulated in the inclined position thereof. The accumulation of bills in the inclined position allows the length of the bill storage in the direction of the width of bills to be shorter than the length of a side of the bills in the direction of transferring the bills, thereby reducing the thickness of the bill storage.

In the bill accumulating mechanism according to the conventional art, the stage, i.e. accumulation table, for accumulating bills thereon is vertically moved by means of a driving belt or spring. Therefore, in order to detect whether or not a bill is put on the accumulation table, it is necessary to provide an assembly of light emitter-optical sensor that forms an optical path in the same direction as the moving direction of the accumulation table such that a bill can be sensed whatever position the accumulation table may occupy.

However, if the accumulation table is adapted for moving a longer distance, the light emitter and optical sensor are separated accordingly by a longer distance, which requires an expensive, higher-sensitive sensor, resulting in an increase in costs. By contrast, if the optical sensor is provided so as to form its optical path in a direction different from the moving direction of the accumulation table, it does not require such a longer distance between the light emitter and the optical sensor that accords to the moving distance of the accumulation table. However, the accumulation table may take its position such that the accumulation table does not interfere with the optical path of the sensor, thus the sensor failing to sense the accumulation table, which is a disadvantage.

SUMMARY OF THE INVENTION

It is an object of the present invention to provide a new and improved medium accumulating device.

It is another object of the present invention to provide a medium accumulating device with a simple configuration, which can determine whether or not a medium such as a bill is accumulated on an accumulation table whatever position the accumulation table may occupy.

In accordance with the present invention, a medium accumulating device includes an accumulation table having a surface at least partially supporting an accumulated medium, an elastic member movably supporting the accumulation table in an accumulating direction of the medium, and an accumulation table detector detecting lowering of the accumulation table.

In that case, the accumulation table detector may be configured to detect whether or not the accumulation table lowers below a predetermined position.

The accumulation table may have a surface inclined with respect to a lifting and lowering direction of the accumulation table.

The medium accumulating device may further include a medium detector that can detect whether or not the medium is accumulated on the accumulation table when the accumulation table is located above the predetermined position. In that case, the medium accumulating device may further include a determiner using a detection result of the accumulation table detector and a detection result of the medium detector to determine whether or not the medium is accumulated on the accumulation table. In that case further, the determiner may be configured to determine that the medium is accumulated on the accumulation table when the accumulation table lowers below the predetermined position or it is detected that the medium is accumulated on the accumulation table.

The determiner may be configured to determine that no medium is accumulated when the accumulation table is located above the predetermined position and it is detected that no medium is accumulated on the accumulation table.

The accumulation table detector may include a first set of light-emitter and optical sensor that form an optical path in a direction intersecting the lifting and lowering direction of the accumulation table, and the medium detector may include a second set of light-emitter and optical sensor that form an optical path in the direction intersecting the lifting and lowering direction of the accumulation table. In that case, the accumulation table detector and the medium detector may be provided on one side with respect to the accumulation table, and the medium accumulating device may further include a first light-guiding member guiding a first optical path to the optical sensor of the first set, and a second light-guiding member guiding a second optical path to the optical sensor of the second set.

The accumulation table may include a light-blocking member blocking the first optical path when the accumulation table is located above the predetermined position.

The accumulation table may include a light-guiding member guiding a first optical path to the optical sensor of the first set when the accumulation table is located above the predetermined position.

The accumulation table detector may include a set of light-emitter and optical sensor that form an optical path in a direction intersecting a lifting and lowering direction of the accumulation table, and the medium accumulating device may include a light-blocking member lowering to a position where the light-blocking member blocks the optical path as the accumulation table lowers. In that case, the accumulation table detector may be configured to detect whether or not the optical path passes a medium accumulating area of the accumulation table and the medium is accumulated on the accumulation table.

The medium accumulating device may further include a determiner using a detection result of the accumulation table detector to determine whether or not a medium is accumulated on the accumulation table.

According to the present invention, it is possible to provide a medium accumulating device which is simpler in configuration and capable of determining whether or not media such as bills are accumulated whatever position the accumulation table may occupy.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
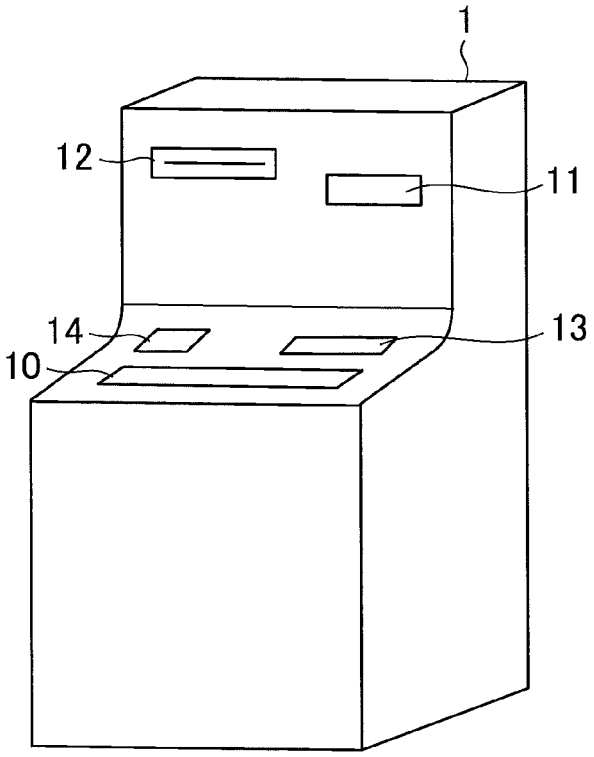
FIG. 1 is a schematic perspective appearance view of an automatic transaction device in accordance with an embodiment of the present invention.

Next, embodiments of a medium accumulating device according to the present invention will be described in detail with reference to appended figures. In the present application, like constituents are given the same reference numerals and repetitive description thereon will be avoided.

Figure 3:
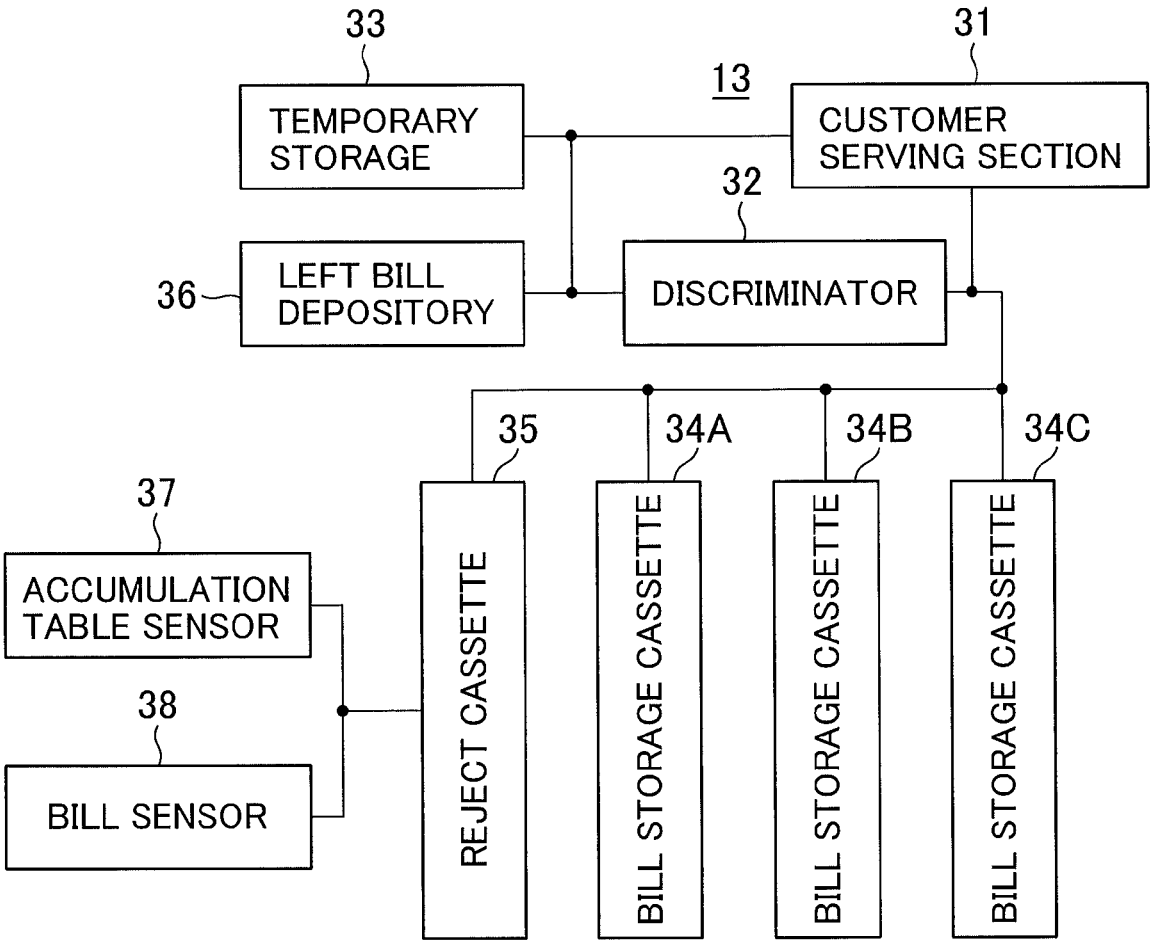
FIG. 3 is a schematic functional block diagram showing the configuration of a bill inlet/outlet port in accordance with the embodiment shown in FIG. 2.

In this application, a plurality of constituents having substantially the same functional configuration may be distinguished from each other by adding different subscripts to the same reference numeral. For example, as described later, FIG. 3 shows three bill storage cassettes 34 having substantially the same functional configuration, which it is necessary to distinguish them from one another, they are designated with reference numerals, e.g. 34A, 34B and 34C. If they need not be distinguished from each other, they are designated with the bill storage cassette 34 without subscript.

With the embodiments of the invention that will be described below, media to be accumulated on an accumulation table are bills, which are merely an example and the present invention is not to be limited to the embodiments. For example, media to be accumulated on the accumulation table may be magnetic cards or IC (Integrated Circuit) cards such as cash cards or credit cards, bankbooks, securities, or tickets for transport or events such as railway tickets, boat tickets, boarding tickets or coupons.

Figure 2:
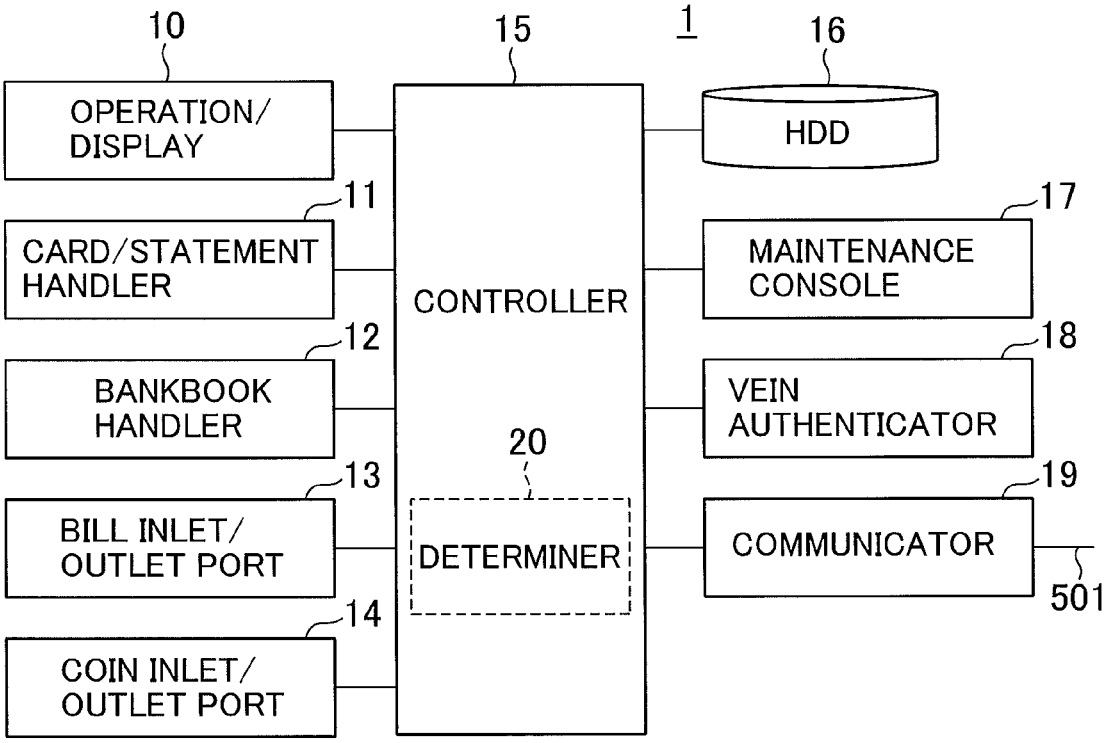
FIG. 2 is a functional block diagram schematically showing the configuration of the automatic transaction device in accordance with the embodiment of the present invention shown in FIG. 1.

Referring first to FIGS. 1 and 2, the configuration of an automatic transaction device in accordance with an embodiment of the present invention will be described. FIG. 1 is a schematic perspective appearance view of the automatic transaction device in accordance with the embodiment of the present invention. As shown in the figure, the automatic transaction device 1 includes an operation/display 10, a card/statement handler 11, a bankbook handler 12, a bill inlet/outlet port 13 and a coin inlet/outlet port 14.

The automatic transaction device 1 is installed in various spots such as banks and stations, and in this embodiment, is a terminal device connected to a central processing system such as a server or a host computer of a financial facility over a telecommunications network 501, FIG. 2, to make transactions required from the customer. Specifically, the operation/display 10 of the automatic transaction device 1 includes functions of presenting a display screen of guiding an operation to the customer and of accepting entries by a customer's manual operation. As the function of accepting the operating input, the operation/display 10 may be implemented by, for example, a touch panel that senses touches on the screen to accept input.

The card/statement handler 11 is a functional section that receives or discharges a magnetic card or an IC card, such as a cash card, that is, a plastic card, not shown, for use in transaction, and discharges a paper strip, i.e. statement, not shown also, on which details of transaction are recorded. The bankbook handler 12 is a functional section that receives or discharges a bankbook, not shown, for use in transaction. The bill inlet/outlet port 13 is a functional section that receives or ejects bills. The coin inlet/outlet port 14 is a functional section that receives or ejects coins. The bill inlet/outlet port 13 and the coin inlet/outlet port 14 are provided with respective shutters, both not shown, which are driven by a driver or drivers to mechanically shield against the outside.

FIG. 2 is a schematic functional block diagram showing the configuration of the automatic transaction device 1 in accordance with the embodiment shown in FIG. 1. As shown in the figure, the automatic transaction device 1 includes, in addition to the operation/display 10, card/statement handler 11, bankbook handler 12, bill inlet/outlet port 13 and coin inlet/outlet port 14, a controller 15, a hard disc device (HDD) 16, a maintenance console 17, a vein authenticator 18 and a communicator 19.

The operation/display 10 includes a display section that displays a display screen guiding operations to the customer, and a customer operating section that detects the customer's manipulation. The function of the display section is implemented by, for example, a cathode ray tube (CRT) display device, a liquid crystal display (LCD) device or an organic light-emitting diode (OLED) device. The function of the customer operating section is implemented by, for example, a touch panel or a mechanical button, not shown. In the automatic transaction device 1 in the instant embodiment, the functions of the display section and the customer operating section are integrated with each other, but the functions of the display section and the customer operating section may be separated from each other.

The card/statement handler 11 is a functional section that reads data from a magnetic card or IC card, such as a cash card the customer presents, and prints transaction details on a paper strip to issues and discharge it as a transaction statement. The bankbook handler 12 is a functional section that prints the content of the transaction made by the automatic transaction device 1 on a bankbook inserted by the customer.

The bill inlet/outlet port 13 is a functional section that counts bills to be returned to the customer or bills to be withdrawn on a withdrawal transaction according to the denominations of bill, and transfers bills to the position where the customer can take the bills. The bill inlet/outlet port 13 also has a function to inspecting bills entered by the customer on a deposit transaction, and counting the bills according to the denominations of bill to store the bills in the automatic transaction device 1.

The coin inlet/outlet port 14 is a functional section that inspects coins entered by the customer on a deposit transaction, and counts the coins according to the denominations of coin to store the coins in the automatic transaction device 1. The coin inlet/outlet port 14 also has a function of counting coins to be withdrawn on a withdrawal transaction, and transfers the coins to the position where the customer can take the coins.

The controller 15 has an overall control function of generally controlling operations of the entire automatic transaction device 1. The controller 15 includes, for example, functions of a communication control that controls communication between the communicator 19 and a host computer, not shown, and a display control that controls display screens to be displayed on the operation/display 10. The controller 15 further includes a determiner 20, which is a functional section that is responsive to sensor results of an accumulation table sensor 37 and a medium sensor 38, described later, FIG. 3 to determine whether or not a bill is put on an accumulation table 164, FIG. 10, in a reject cassette 35. Details of the determiner 20 will be described later with reference to FIG. 14.

The hard disc drive (HDD) 16 is a storage device that stores control program sequences, files and the like, which are necessary for operating the automatic transaction device 1.

The maintenance console 17 is an interface for the clerk, and has the functions of displaying information such as failures and troubles of the respective sections of this device, and of accepting a clerk's operation for addressing the failures or troubles of those sections.

The vein authenticator 18 is an authenticator for confirming personal identification. In the instant embodiment, the customer is identified by reading a vein pattern of a customer's palm and comparing the read vein pattern with a vein pattern recorded in advance on the IC chip, not shown, of a cash card inserted into the card/statement handler 11 by the customer.

The communicator 19 is an interface with a host computer for transmitting and receiving information necessary for transaction to and from the host computer over a telecommunications line 501. The information necessary for transaction includes, for example, customer information such as an account number, a password and a balance in account of the customer, and information on transaction content, such as the deposited or withdrawn amount of money.

Subsequently, referring to FIG. 3, description will be made on the schematic configuration of the bill inlet/outlet port 13 of the automatic transaction device 1. FIG. 3 is a schematic functional block diagram showing an example of the configuration of the bill inlet/outlet port 13. As can be seen from the figure, the bill inlet/outlet port 13 includes a customer serving section 31, a discriminator 32, a temporary storage 33, bill storage cassettes 34A, 34B and 34C, a reject cassette 35, a left bill depository 36, an accumulation table sensor 37, and a bill sensor 38.

The customer serving section 31 functions as an inlet section that separates bills put by the customer one by one on a deposit transaction and transfers the bills to, for example, the discriminator 32. The customer serving section 31 collects bills to be returned to the customer or bills to be delivered to the customer on a withdrawal transaction.

The discriminator 32 determines the real/counterfeit, denomination and damage of bills transferred from the customer serving section 31, as well as detects a transfer failure and counts the bills whose denomination has been established. In the context, the denomination of bill is directed to the denomination of bills predominantly circulating in one region, such as 1000-yen, 5000-yen and 10000-yen bills.

The temporary storage 33 is a functional section that temporarily holds a bill discriminated to be acceptable by the discriminator 32 on a deposit transaction until the deposit is established.

The bill storage cassettes 34A, 34B and 34C are storages that store bills entered in the customer serving section 31 by the customer. Bills to be withdrawn to the customer are also stored in the bill storage cassettes 34A, 34B and 34C to be taken out therefrom.

The reject cassette 35 is a storage section that stores bills which would the discriminator 32 has determined not be fed to the customer on a withdrawal or deposit transaction but to be collected. For example, the discriminator 32 may be configured to discriminate bills of denomination unfixed, specified denomination, damaged or dirtied as bills to be collected. The bills stored in the reject cassette 35 will be taken out and collected by the operator. Such a reject cassette 35 and the automatic transaction device 1 having such a reject cassette 35 are specific to automated teller machines, which are adapted to accumulate bills as media, and are a mere example of medium accumulating device according to the present invention.

The left bill depository 36 is a storage that stores bills left by the customer on a withdrawal or deposit transaction.

Figure 10:
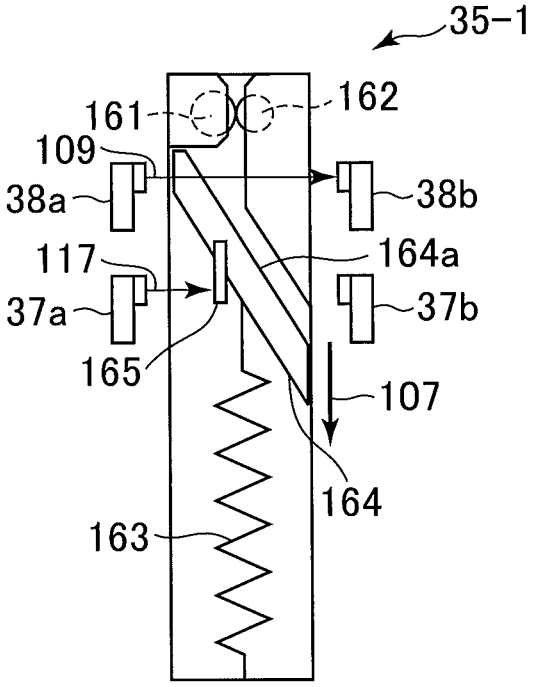
FIG. 10 is a schematic vertical sectional view showing the configuration of a reject cassette in accordance with the first embodiment of the present invention.

The accumulation table sensor 37 is an optical sensor that senses the accumulation table 164, FIG. 10, in the reject cassette 35, on which bills will be accumulated. The bill sensor 38 is an optical sensor that detects whether or not a bill is accumulated on the accumulation table 164 in the reject cassette 35.

A specific configuration that detects whether or not a bill is put on the accumulation table 164 in the reject cassette 35 will be described in comparison with comparative examples. First, the reject cassette that accumulates a medium in its horizontal position will be described with reference to FIGS. 4A to 5B.

Figure 4A:
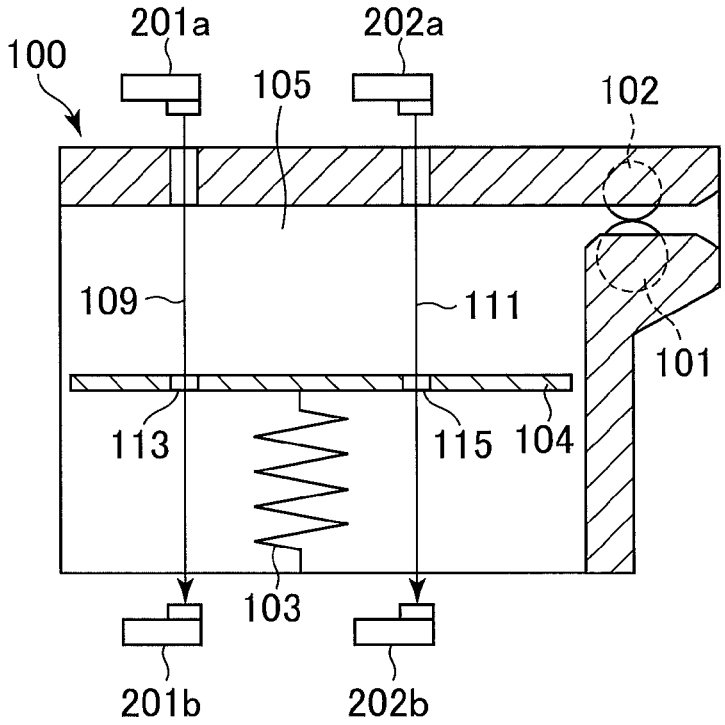
FIGS. 4A and 4B are schematic vertical sectional views showing the configuration of a reject cassette in accordance with Comparative Example 1.
Figure 4B:
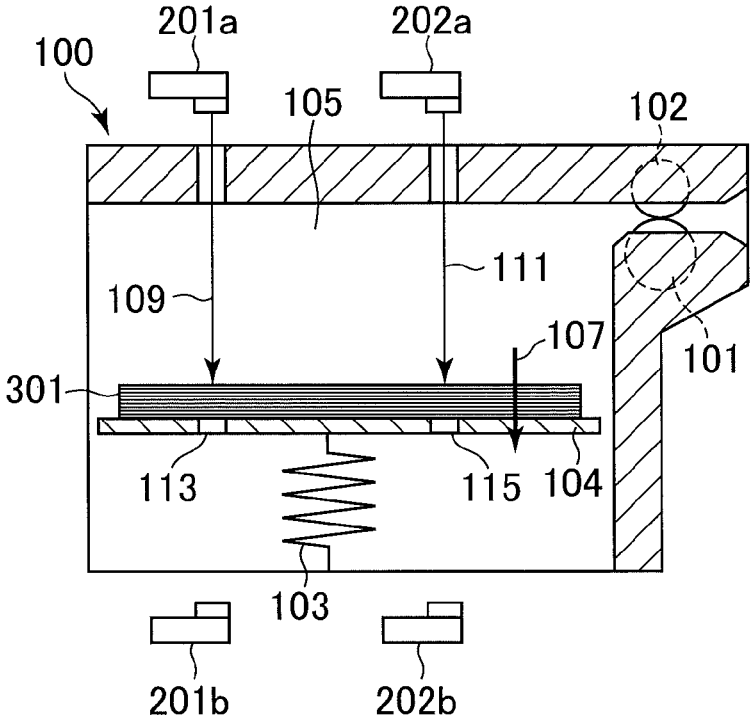

FIG. 4A is a schematic vertical sectional view showing the configuration of a reject cassette 100 in accordance with Comparative Example 1. The reject cassette 100 includes a driving roller 101, an idle roller 102, an accumulation table 104, and a stage spring 103. In order to determine whether or not bills 301 are accumulated in the reject cassette 100, FIG. 4B, there are provided outside the reject cassette 100 a residue detector 201 in the form of an assembly of light-emitter 201*a* and optical sensor 201*b*, and a residue detector 202 in the form of an assembly of light-emitter 202*a* and optical sensor 202*b*.

Since the reject cassette 100 is a cassette that is dedicated for accumulation as described above and would not feed out accumulated bills, no electrical component is provided in a medium accumulation space 105 but as shown in FIG. 4A, the residue detectors 201 and 202 are provided outside the reject cassette 100. Since the reject cassette 100 may store a bent bill, it is necessary to provide such a plurality of residue detectors 201 and 202 so as to monitor plural spots on the accumulation table 104.

In the reject cassette 100 in Comparative Example 1, the bills 301 are drawn from the transfer path, not shown, by the driving roller 101 and the idle roller 102 into the cassette 100 to be accumulated on the accumulation table 104. The accumulation table 104 is supported by the stage spring 103, and guided by a sliding groove and a shaft, not shown, to be lowered in the direction of an arrow 107 by the self-weight of the accumulated bills 301, FIG. 4B.

The residue detectors 201 and 202 provided in the reject cassette 100 form respective optical paths 109 and 111 in substantially the same direction as the moving direction of the accumulation table 104, and are arranged so that the optical paths 109 and 111 pass respective, optically transparent holes 113 and 115, which are provided in the accumulation table 104. Accordingly, when the accumulation table 104 is located at any position in a vertical direction 107, that is, at any height, the optical path 109 or 111 is blocked while the bills 301 are accumulated on the accumulation table 104, so that it can be determined that the bills 301 exist in the cassette 100.

Figure 5A:
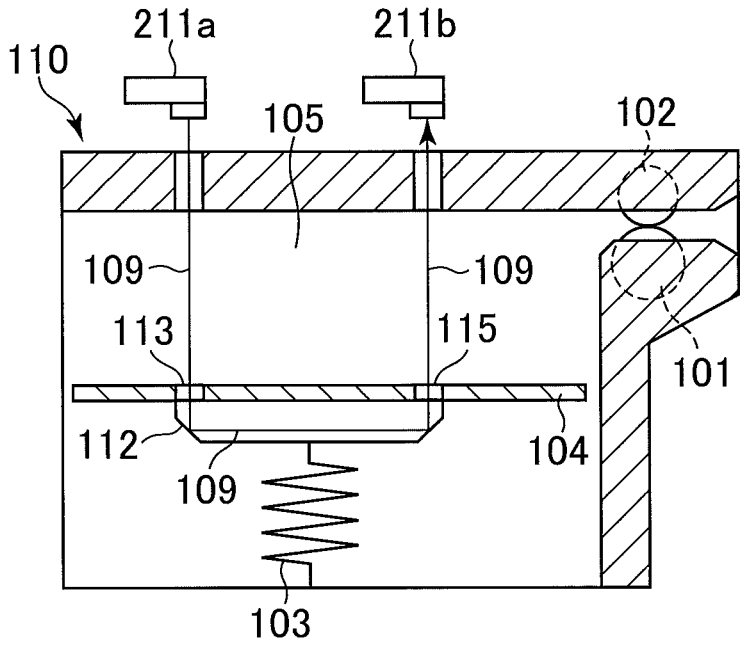
FIGS. 5A and 5B are schematic vertical sectional views showing the configuration of a reject cassette in accordance with Comparative Example 2.
Figure 5B:
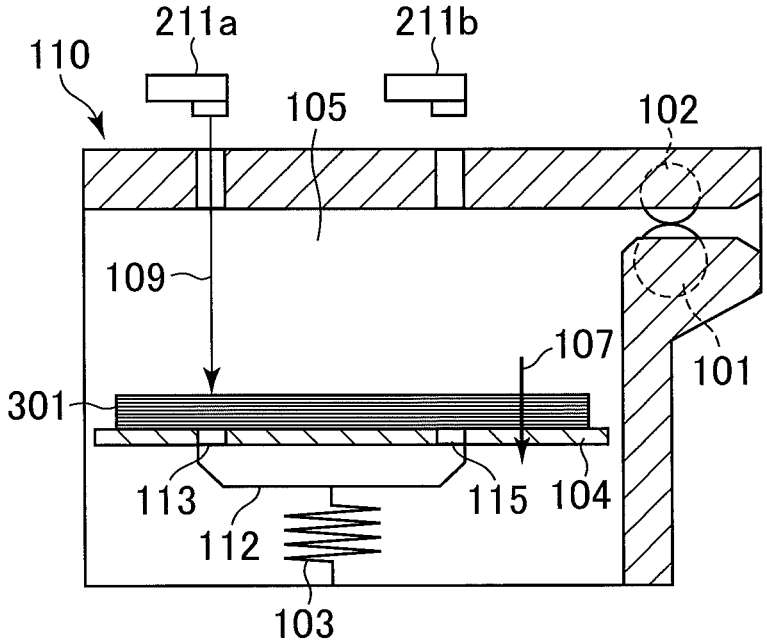

FIG. 5A is a schematic vertical sectional view showing the configuration of a reject cassette 110 in accordance with Comparative Example 2. In the case where the distance between a residue detector 211 including a light-emitter 211*a* and an optical sensor 211*b* and the accumulation table 104 is small, and the sensitivity of the residue detector 211 is sufficient, an optical prism 112 that refracts and guides the optical path 109 as shown in the figure may be provided in the accumulation table 104 such that the optical path 109 is blocked by the bills 301 as shown in FIG. 5B. This can reduce the number and mounting space of the sensors, thereby miniaturizing the device.

In the reject cassettes 100 and 110 in the above-mentioned comparative examples, the width of the reject cassette, which corresponds to the side of the bill 301 in the transfer direction, when viewed from the accumulating direction 107 of the bills 301, that is, from above in the figures, needs to be equivalent to the sum of the width of the transfer path, larger one of the widths of the driving roller and the idle roller, and the width of the bill storing section (accumulation table), which would restrict the miniaturization.

Figure 6A:
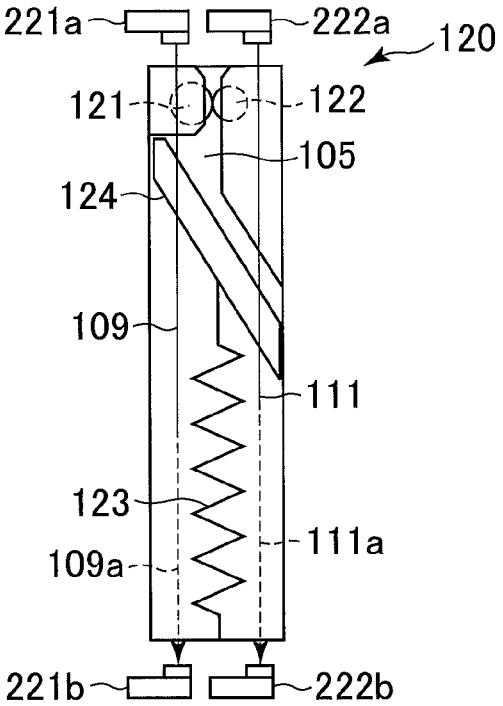
FIGS. 6A and 6B are schematic vertical sectional views showing the configuration of a reject cassette in accordance with Comparative Example 3.
Figure 6B:
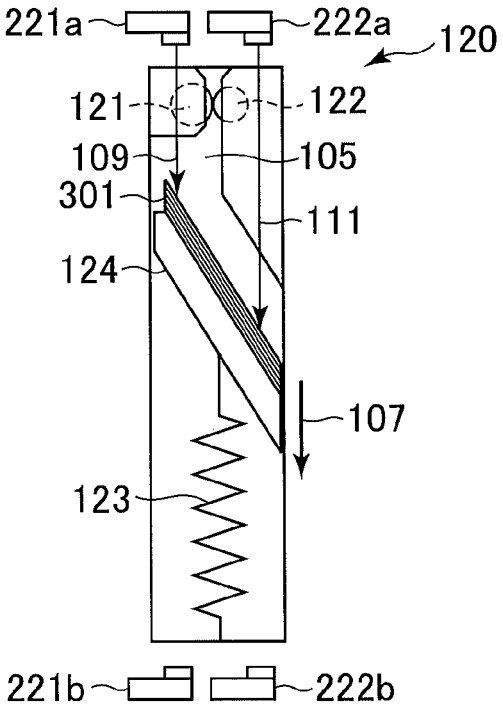

By contrast, in Comparative Example 3, an accumulation table 124 has its bill accumulating surface inclined as shown in FIG. 6A, and the bills 301 transferred on a transfer path, not shown, provided above a reject cassette 120 are accumulated vertically in the inclined position thereof along the inclined surface as shown in FIG. 6B. That allows that width of the reject cassette 120 which corresponds to the side of the bill in the transfer direction to be decreased with less restriction, thereby implementing the thinner cassette.

In this Comparative Example, a residue detector 221 including a light-emitter 221*a* and an optical sensor 221*b* as well as a residue detector 222 including a light-emitter 222*a* and an optical sensor 222*b* are provided so as to form the respective optical paths 109 and 111 in the same direction as the moving, that is, lifting and lowering direction 107 of the accumulation table 124. Thus, as in Comparative Example 1, when the accumulation table 104 is located at any position in the vertical direction 107, the optical path 109 or 111 is blocked while the bills 301 are accumulated on the accumulation table 124, so that it can be determined that the bills 301 exist in the cassette 120.

Figure 7A:
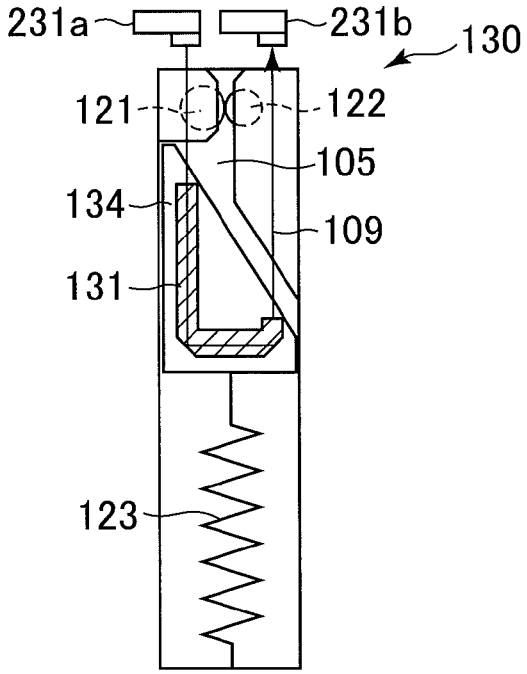
FIGS. 7A and 7B are schematic vertical sectional views showing the configuration of a reject cassette in accordance with Comparative Example 4.
Figure 7B:
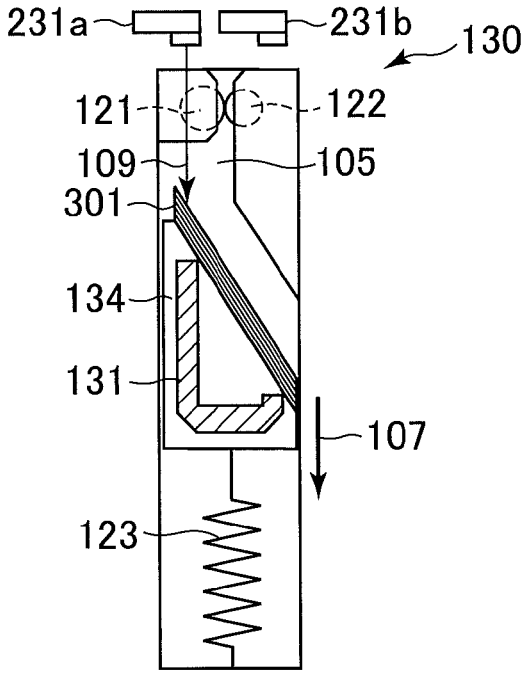

In a reject cassette 130 in Comparative Example 4, as shown in FIG. 7A, where the distance between residue detector 231 including a light-emitter 231*a* and an optical sensor 231*b* and an accumulation table 134 is small, and the sensitivity of the residue detector 231 is sufficient, an optical prism 131 that refracts and guides the optical path 109 is provided in the accumulation table 134 such that the optical path 109 is blocked by the bills 301 as shown in FIG. 7B. This can reduce the number and mounting space of the sensors, thereby miniaturizing the device.

The thin reject cassettes 130 and 140 in Comparative Examples 3 and 4 are configured so as to accumulate the bills 301 in the inclined position thereof. Such accumulation in the inclined position can decrease the required width of the accumulation space 105, implementing the thinner reject cassette. Now, the height of the accumulation space 105, which is required for the accumulation in the inclined position, will be described as compared to the height required for the accumulation in the horizontal position.

First, the height of the accumulation space, which is required for the accumulation in the horizontal position, will be described with reference to FIG. 23. As can be seen from the figure, the height of the accumulation space, which is required to accumulate the bills 301 in the horizontal position, is of course equal to the height H where the bills 301 are accumulated.

Figure 23:
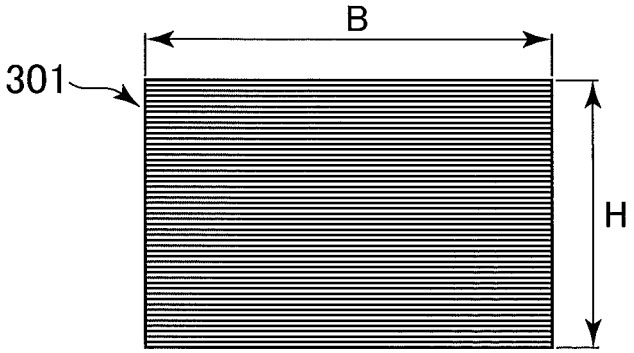
FIG. 23 is a diagrammatic elevation view showing bills accumulated in the horizontal position.
Figure 24:
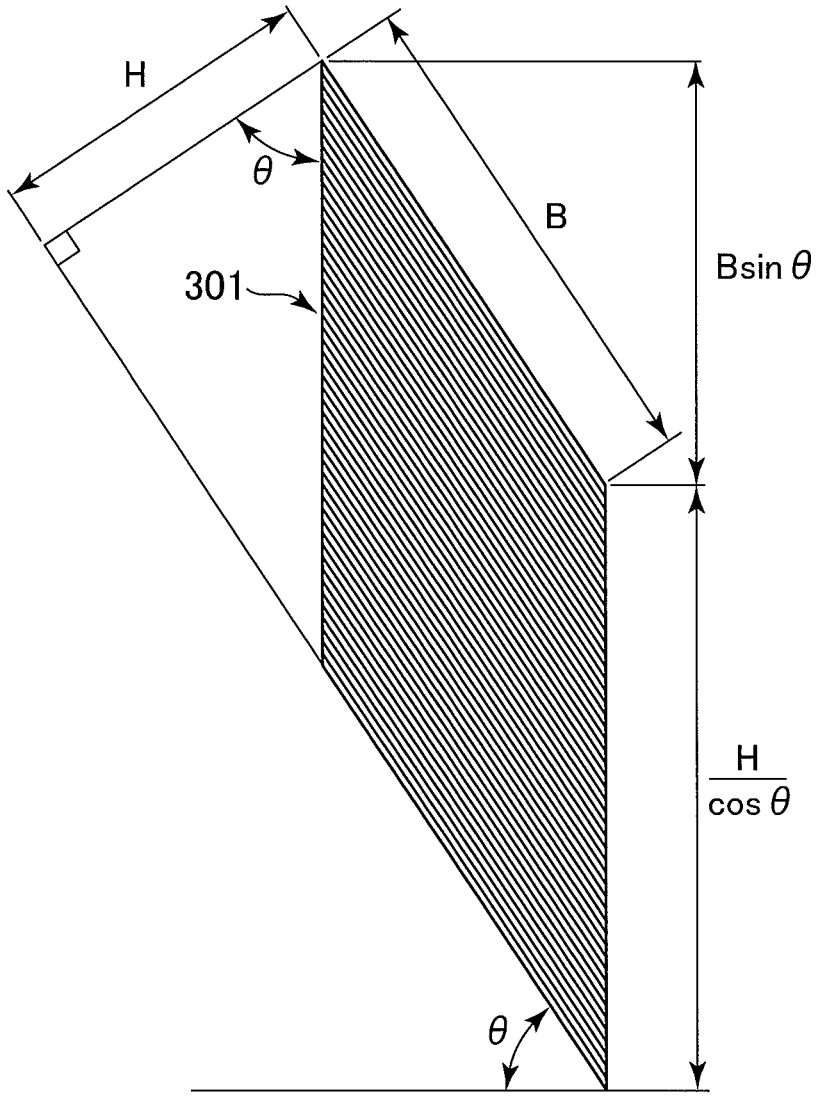
FIG. 24 is a diagrammatic elevation view showing bills accumulated in the inclined position.

The height of the accumulation space 105, which is required when the same number of bills 301 as the example shown in FIG. 23 are accumulated in the inclined position, will be described with reference to FIG. 24. As can be seen from the figure, the height of the accumulation space, which is required when the bills 301 are accumulated at an inclination angle θ, is found according to the following expression (1).

[Expression 1]

$$B \sin\theta + H/\cos\theta, \quad (1)$$

where $0 \leq \theta \leq 90°$, $0 < \sin\theta < 1$ and $0 < \cos\theta < 0$.

Thus, with the thin reject cassettes 120 and 130 that accumulate the bills 301 in the inclined position, as the angle θ of the bills 301 is larger, the width of the accumulation space 105 can be smaller, but the height of the accumulation space 105 needs to be larger. Accordingly, with the thin reject cassette 120 that is shorter in the width direction and longer in the height direction, the distance between the light-emitter and the optical sensor on each of the optical paths 109 and 111 formed by the residue detectors 221 and 222, respectively, is longer than that in the example shown in FIG. 4A by the lengths represented by broken lines 109*a* and 111*a* in FIG. 6A. This requires an expensive high-sensitive sensor, thus problematically leading to an increase in costs. Further, since a driving roller 121 and an idle roller 122 exist between the light-emitter 221*a* and the optical sensor 221*b*, the positional arrangement of the light-emitter 221*a* and the optical sensor 221*b* that form the optical path 109 is disadvantageously restricted.

Figure 8A:
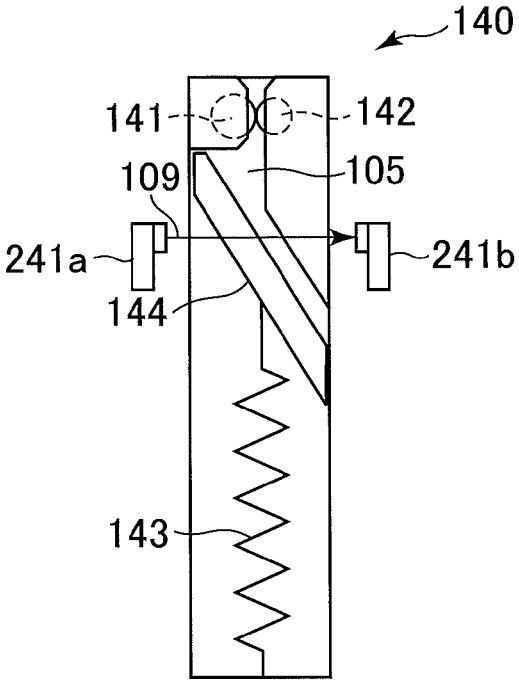
FIGS. 8A and 8B are schematic vertical sectional views showing the configuration of a reject cassette in accordance with Comparative Example 5.
Figure 8B:
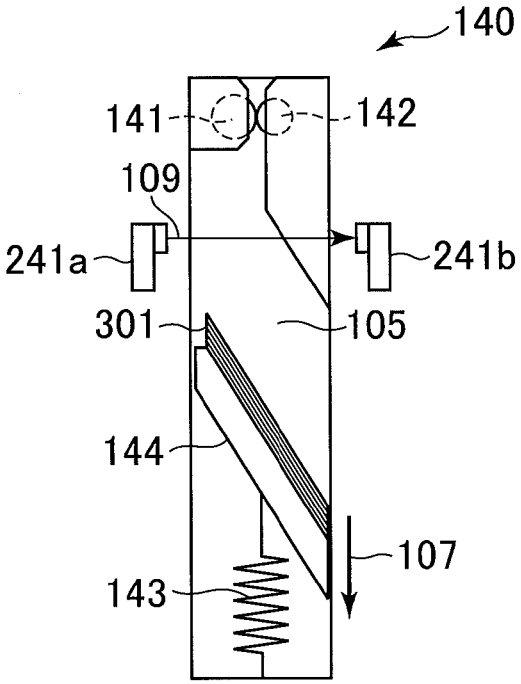

Thus, in Comparative Example 5 shown in FIG. 8A, the above-mentioned problem is solved by arranging a residue detector 241 so as to form the optical path 109 from a light-emitter 241*a* to an optical sensor 241*b* in a direction that is different from the moving, that is, lifting and lowering direction 107 of an accumulation table 144, FIG. 8B. In the reject cassette 140, when the optical path 109 formed by the residue detector 241 is not blocked by the bills 301, it is determined that no bill exists. However, depending on the weight and thickness of the bills 301 accumulated on the accumulation table 144, the accumulation table 144 may lower across a length exceeding a designed value, so that the bills 301, although accumulated as shown in FIG. 8B, fail to interrupt the optical path 109 to be determined as no bill existing.

Figure 9:
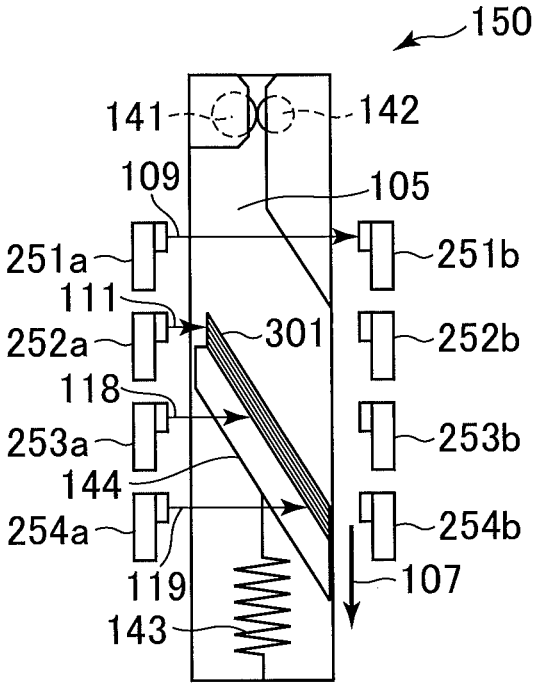
FIG. 9 is a schematic vertical sectional view showing the configuration of a reject cassette in accordance with Comparative Example 6.

Now, a reject cassette 150 in accordance with Comparative Example 6 shown in FIG. 9 has a plurality of optical paths 109, 111, 118 and 119 formed in a distance over which the accumulation table 144 moves to thereby detect whether or not the bills 301 are accumulated whatever position the accumulation table 144 may occupy.

Alternatively, an actuator, not shown, that raises and lowers the accumulation table 144 may be added, and the upper surface of the uppermost accumulated bills 301 may be controlled in height so as to fall within the optical path 109 formed by the residue detector.

However, any of the above-mentioned configurations in Comparative Example 6 disadvantageously cause an increase in costs and space of the device.

Thus, taking account of those circumstances, the Inventor made the present invention. In accordance with embodiments of the present invention, it is detected an accumulation table on which bills are accumulated is lowered, thereby making it possible to determine whether or not media are accumulated on the accumulation table. Embodiments of the present invention will be described in detail.

Figure 12:
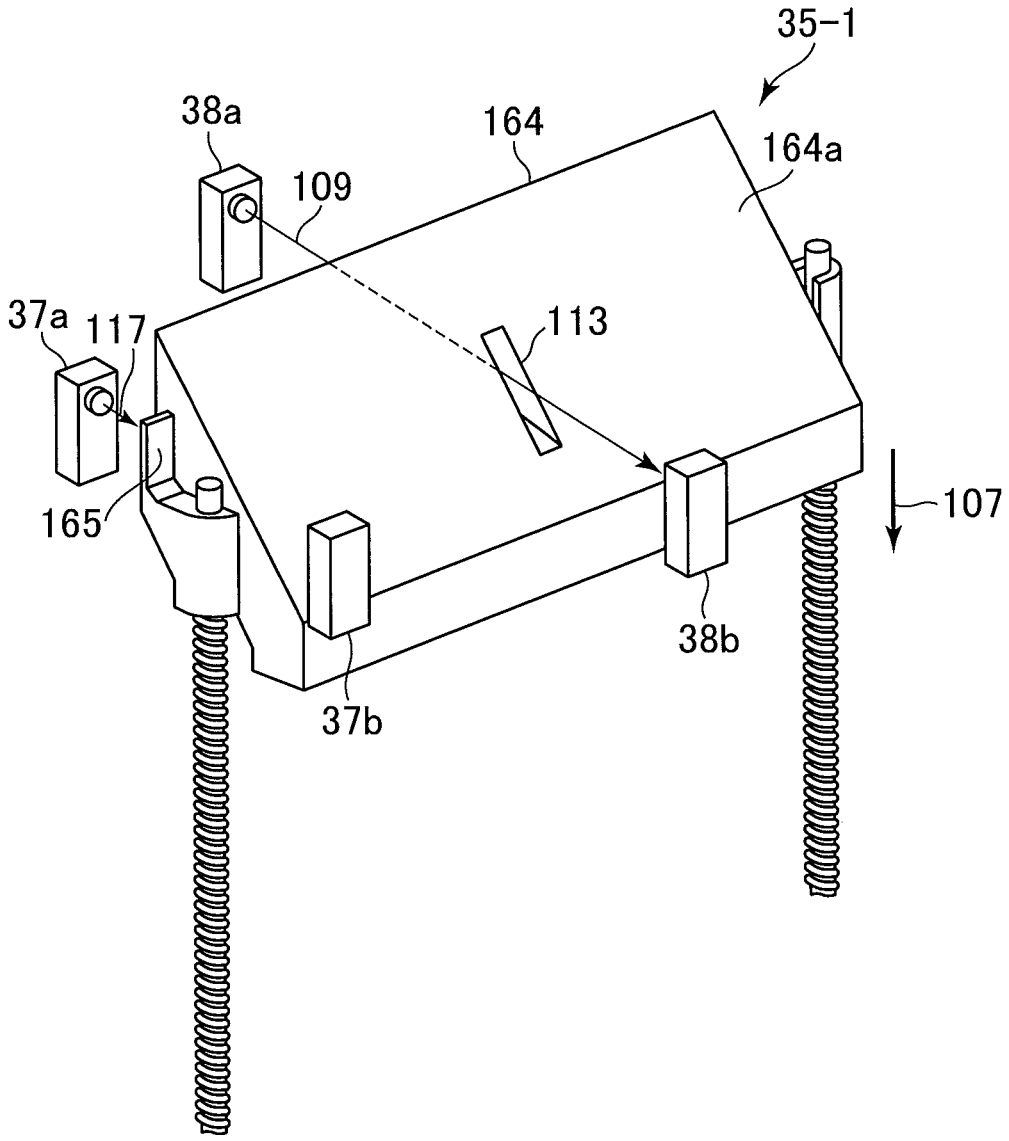
FIG. 12 is a schematic perspective view showing the reject cassette shown in FIG. 10.

FIG. 10 is a schematic vertical sectional view showing the configuration of a reject cassette 35-1 in accordance with the first embodiment of the present invention. FIG. 12 is a schematic perspective view of the reject cassette 35-1 in accordance with the embodiment shown in FIG. 10. As can be seen from FIGS. 10 and 12, the reject cassette 35-1 in accordance with the instant embodiment includes a driving roller 161, an idle roller 162, a stage spring 163, an accumulation table 164 and a stage detector 165.

Outside the reject cassette 35-1, there is provided a bill sensor 38 including a set of light-emitter 38*a* and optical sensor 38*b*, which forms an optical path 109 in a direction intersecting the moving direction 107 of the accumulation table 164 and detects whether or not bills 301 are accumulated. Outside of the reject cassette 35-1, there is also provided an accumulation table sensor 37 including a set of light-emitter 37*a* and optical sensor 37*b*, which also detects the lowering of the accumulation table 164. Constituents of the reject cassette 35-1 will be described below.

The driving roller 161 and the idle roller 162 are feeder members that draw the bills 301 from the transfer path, not shown. The stage spring 163 is an elastic member that supports the accumulation table 164. Although FIG. 10 shows one stage spring 163 as an example of the elastic member, the present invention is not limited to this example. For example, a plurality of springs may be provided as elastic members supporting the accumulation table 164. In addition, although FIG. 10 exemplarily shows the spring as an elastic member, an elastic member elastically deformable depending on the load of bills may be used.

The accumulation table 164 has its inclined surface 164*a* inclined with respect to the lifting and lowering direction 107 of the accumulation table 164. The inclined surface 164*a* may be sufficient to at least partially support the accumulated bills 301, FIG. 11A, that is, may be partially opened or reticulated. Preferably, the inclined surface 164*a* forms a flat plane. The bills 301, FIG. 13, drawn by the driving roller 161 and the idle roller 162 are accumulated on the inclined surface 164*a*. As the bills 301 are accumulated on the accumulation table 164, the stage spring 163 is compressed by the weight of the accumulated bills 301. More specifically, as the bills 301 are accumulated on the accumulation table 164, the accumulation table 164 supported by the stage spring 163 lowers in the direction of the arrow 107 with the compression of the stage spring 163.

As shown in FIG. 12, the stage detector 165 is fixed on the accumulation table 164 at such a position, outside the region where the bills 301 will be accumulated, as not to interfere with the optical path 109 formed by the bill sensor 38. Thus, the stage detector 165 moves in the lifting and lowering direction 107 together with the accumulation table 164. The stage detector 165 is provided at a position where an optical path 117 formed by the accumulation table sensor 37 is blocked by the accumulation table 164, when lifted above a predetermined height, i.e. predetermined position in the lifting and lowering direction 107, of the accumulation table 164. The predetermined position may be, for example, a home position of the accumulation table 164, or a height taken when the bills 301 are hardly accumulated.

As described above, the reject cassette 35-1 in accordance with the present embodiment is arranged, as shown in FIG. 12, such that, when the accumulation table 164 lifts above the predetermined position, the stage detector 165 provided on the accumulation table 164 blocks the optical path 117 formed by the accumulation table sensor 37. By contrast, when the accumulation table 164 lowers below the predetermined position, the stage detector 165 lowers together with the accumulation table 164, resulting in that the optical path 117 formed by the accumulation table sensor 37 is not blocked by the stage detector 165. As described above, depending on whether or not the optical path 117 formed by the accumulation table sensor 37 is blocked by the stage detector 165, it can be determined whether or not the accumulation table 164 lowers below the predetermined position.

Figure 13:
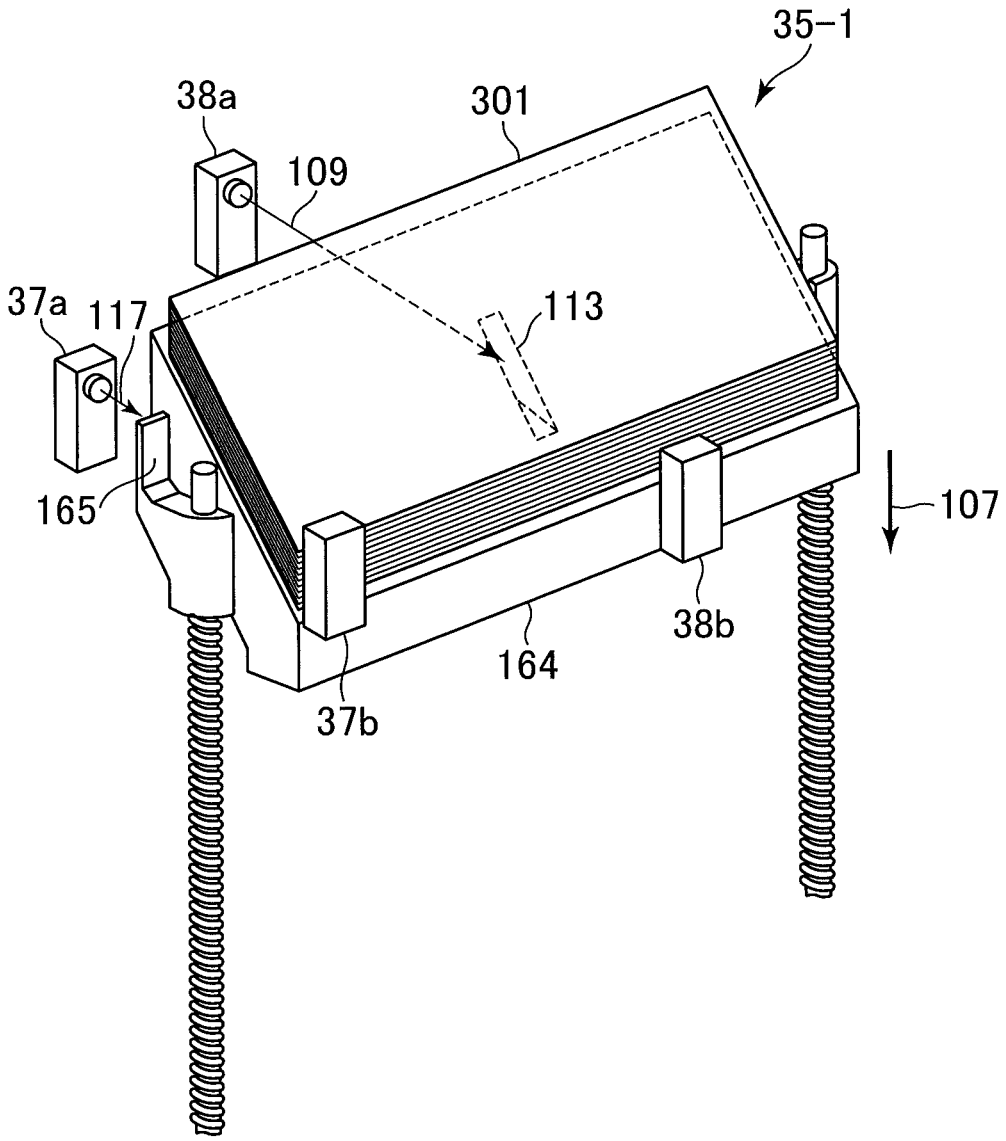
FIG. 13 is a schematic perspective view showing a state where bills are accumulated in the reject cassette shown in FIG. 10.

The bill sensor 38 includes, as described above, the light-emitter 38*a* and the optical sensor 38*b*. The light-emitter 38*a* and the optical sensor 38*b* are, as shown in FIG. 12, opposed to each other across the accumulation table 164. As can be seen from the figure, when no bill 301 is accumulated on the accumulation table 164, which is located at its uppermost position in the lifting and lowering distance, that is, home position, the optical path 109 formed from the light-emitter 38*a* toward the optical sensor 38*b* passes through an optical slit 113 formed in the accumulation table 164. By contrast, as shown in FIG. 13, when the bills 301 are accumulated on the accumulation table 164, the optical path 109 formed from the light-emitter 38*a* toward the optical sensor 38*b* is blocked by the bills 301 as long as the accumulation table 164 is located above the predetermined position. As described above, the reject cassette 35-1 is configured such that when the stage detector 165 blocks the optical path 117 formed by the accumulation table sensor 37, the bill sensor 38 can detect that the bills 301 are accumulated on the accumulation table 164. Although the accumulation table 164 has at least its part, that is, the optical slit 113 in the present embodiment, optically transparent, the entire accumulation table 164 may be transparent.

Figures 14, 15:
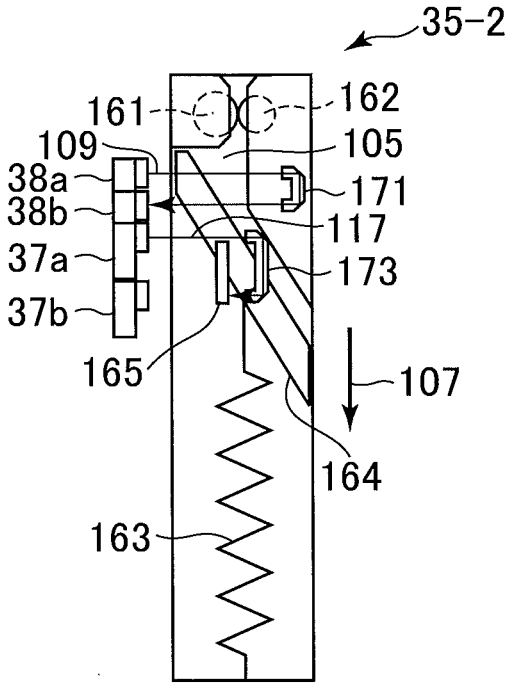
FIG. 14 shows a combination of logics of sensing results of sensors in the first embodiment for use in a determiner determining whether or not bills are accumulated.
FIG. 15 is a schematic vertical sectional view showing the configuration of a reject cassette in accordance with the second embodiment of the present invention.

In the embodiment shown in FIG. 2, the determiner 20 uses the detection results of the accumulation table sensor 37 and the medium sensor 38 to determine whether or not the bills 301 are accumulated on the accumulation table 164 of the reject cassette 35-1. Referring to FIG. 14, the determination function of the determiner 20 will be specifically described below.

FIG. 14 shows the detection results of the accumulation table sensor 37 and the bill sensor 38 and determination logics of the determiner 20. In the instant embodiment, since the sensors 37 and 38 are optical sensors, when light beams 109 and 111 emitted from the light-emitters 37*a* and 38*a*, respectively, are received by the optical sensors 37*b* and 38*b*, the detection results show "bright", and when the optical paths 109 and 111 are blocked by the bills 301 and the stage detector 165, respectively, the detection results show "dark".

As can be seen from FIG. 14, the determiner 20 determines that the bills 301 are accumulated on the accumulation table 164 when the detection result of the accumulation table sensor 37 shows "bright" or the detection result of the bill sensor 38 shows "dark". In other words, the determiner 20 determines that the bills 301 are accumulated on the accumulation table 164 when the accumulation table sensor 37 senses that the accumulation table 164 lowers below the predetermined position, or the bill sensor 38 senses that the bills 301 are accumulated.

By contrast, when the detection results of the accumulation table sensor 37 and bill sensor 38 shows "dark" and "bright", respectively, the determiner 20 determines that no bill 301 is accumulated on the accumulation table 164. In other words, when the accumulation table sensor 37 senses that the accumulation table 164 is located above the predetermined position, and the bill sensor 38 does not sense that the bills 301 are accumulated, the determiner 20 determines that no bill 301 is accumulated on the accumulation table 164.

Figure 11A:
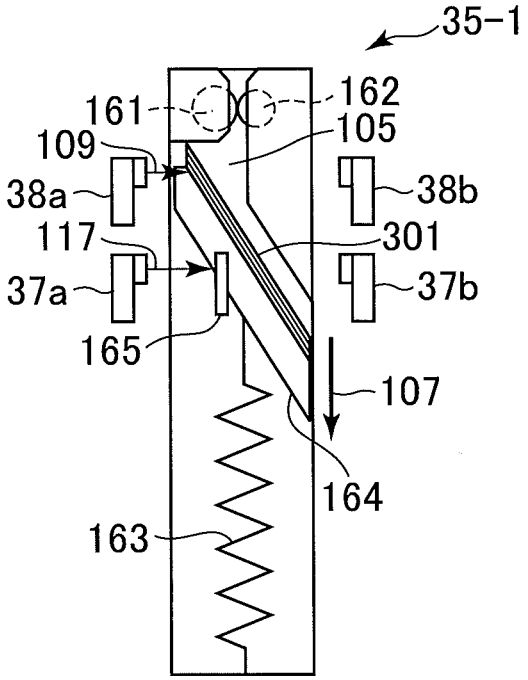
FIGS. 11A, 11B and 11C are schematic vertical sectional views showing a state transition during accumulation of bills in the reject cassette shown in FIG. 10.

Subsequently, referring to FIGS. 11A, 11B and 11C, description will be made on a state transition during the accumulation of the bills 301 in the reject cassette 35-1, that is, a process of lowering the accumulation table 164 will be described. Those figures are schematic, vertical sectional view specifically showing the state transition during the accumulation of the bills 301 in the reject cassette 35-1.

When no bill 301 is accumulated on the accumulation table 164 of the reject cassette 35-1, as shown in FIG. 10, the accumulation table 164 is raised to its home position by the stage spring 163. After that, when the bills 301 are accumulated on the accumulation table 164, as shown in FIG. 11A, the optical path 109 formed by the bill sensor 38 is blocked by the bills 301. If the accumulation table 164 lowers more or less due to the weight of the accumulated bills 301, as long as the accumulation table 164 resides above the predetermined position, the optical path 109 formed by the accumulation table sensor 37 is then blocked by the stage detector 165. At this time, since the detection results of both accumulation table sensor 37 and bill sensor 38 show "dark", the determiner 20 determines that the bills 301 are accumulated on the accumulation table 164 according to the logical relationship shown in FIG. 14.

Figure 11B:
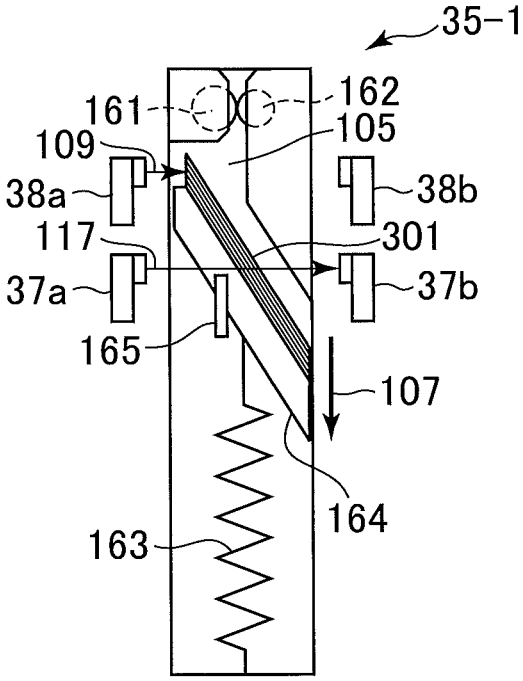

Then, as shown in FIG. 11B, when the bills 301 are further accumulated on the accumulation table 164, the accumulation table 164 lowers due to the weight of the bills 301, and the optical path 117 formed by the accumulation table sensor 37 becomes not blocked by the stage detector 165 provided in the accumulation table 164, whereas the optical path 109 formed by the bill sensor 38 is still blocked by the bills 301. Thus, since the detection results of the accumulation table sensor 37 and bill sensor 38 show "bright" and "dark", respectively, the determiner 20 determines that the bills 301 are accumulated on the accumulation table 164 according to the logical relationship shown in FIG. 14.

Figure 11C:
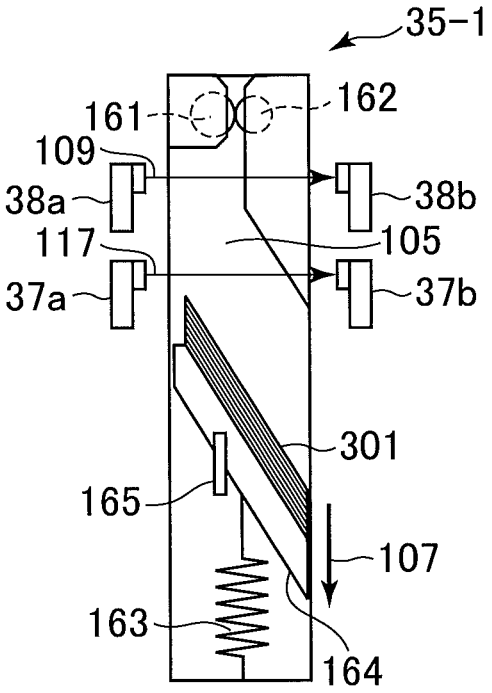

However, depending on the weight or thickness of the bills 301, for example, when the bills 301 are wet, as shown in FIG. 11C, the accumulation table 164 may be lowered further from the normal position, and thus the optical path 109 formed by the bill sensor 38 may become not blocked by the bills 301. However, in this case, since the detection results of both of the accumulation table sensor 37 and the bill sensor 38 show "bright", the determiner 20 determines that the bills 301 are accumulated on the accumulation table 164 according to the logical relationship shown in FIG. 14.

However, when the operator removes all of the bills 301 from the reject cassette 35-1, the bill weight becomes zero, and the accumulation table 164 is raised to a stopper, not shown, by the repulsive force of the stage spring 163 and returns to its home position. At the home position, as shown in FIG. 10, the optical path 117 formed by the accumulation table sensor 37 is blocked by the stage detector 165. However, the optical path 109 formed by the bill sensor 38 is not blocked by the bills 301. Thus, since the detection result of the accumulation table sensor 37 and bill sensor 38 show "dark" and "bright", respectively, the determiner 20 determines that no bill 301 is accumulated on the accumulation table 164 according to the logical relationship shown in FIG. 14.

In summary, in the instant embodiment, it is detected whether or not the accumulation table 164 lowers below the predetermined position depending on whether or not the optical path 117 formed by the accumulation table sensor 37 is blocked by the stage detector 165. In the embodiment, when the accumulation table 164 lowers below the predetermined position, the determiner 20 determines that the bills exist in any case. Depending on the weight of the bills 301, however, when the accumulation table 164 does not lower below the predetermined position, the bills 301 may be accumulated on the accumulation table 164 as shown in FIG. 11A. Thus, the bill sensor 38 is configured so as to determine whether or not the bills 301 are accumulated on the accumulation table 164 at least when the accumulation table 164 is located above the predetermined position. It can thus be determined more correctly whether or not the bills 301 are accumulated.

In the instant embodiment, the optical paths 109 and 111 of the sensors 37, 38 may be formed in a direction that is different from the lifting and lowering direction 107 of the accumulation table 164, in which case the determiner 20 can correctly determine whether or not the bills 301 are accumulated, irrespective of the position of the accumulation table 164 or the bill accumulation state.

In accordance with the present embodiment, whether or not the accumulated bills 301 are accumulated on the accumulation table 164 can be correctly determined with a small number of sensors without providing, as in Comparative Example 6 shown in FIG. 9, plural sensors 251 in the lifting and lowering direction 107 of the accumulation table 144, thus reducing costs of the entire device.

In the present embodiment, since the optical path 109 of the sensor need not be parallel to the lifting and lowering, that is, moving direction 107 of the accumulation table 164, the sensors may be applied to the thin cassette 120, FIG. 6A, as in Comparative Example 3 in which the bills are accumulated in the inclined position, the distance between the sensors will not be extended. Therefore, an inexpensive sensor can be used instead of an expensive long-distance sensor.

In the instant embodiment, since the optical path 109 of the sensor can be formed in a direction that is different from the lifting and lowering direction 107 of the accumulation table 164, the sensor optical path is not affected by the driving roller 161 and the idle roller 162, and therefore, the sensor can be freely arranged in position.

Well, FIG. 15 is a schematic vertical sectional view showing the configuration of a reject cassette 35-2 in accordance with the second embodiment of the present invention. As shown in the figure, the reject cassette 35-2 in accordance with the instant embodiment has first and second prisms 171 and 173 in addition to the driving roller 161, the idle roller 162, the stage spring 163, the accumulation table 164 and the stage detector 165.

On one side of the reject cassette 35-2, that is, on the left side in FIG. 15, a bill sensor 38 including a set of light-emitter 38*a* and optical sensor 38*b* is provided to form the optical path 109 in the direction intersecting with the moving direction 107 of the accumulation table 164 to detect whether or not bills 301 are accumulated. Outside the reject cassette 35-1, the accumulation table sensor 37 is provided which includes a set of light-emitter 37*a* and an optical sensor 37*b* to sense the accumulation table 164 being lowered. The constituents will be described below.

Since the driving roller 161, the idle roller 162, the stage spring 163, the accumulation table 164 and the stage detector 165 may be the same as the first embodiment, the description thereof will not be repeated.

The first prism 171 is an optical element which has its side shaped as illustrated and refracts the light beam 109 emitted from the light-emitter 38*a* of the bill sensor 38 to guide the latter to the optical sensor 38*b*. The second prism 173 is also an optical element that has its side shaped as illustrated and refracts the light beam 111 from the light-emitter 37*a* of the accumulation table sensor 37 to guides the latter to the optical sensor 37*b*. The prisms 171 and 173 may be fixedly provided at a position that does not move with movement of the accumulation table 164, for example, on the housing of the cassette 35-2.

As described above, in the instant embodiment, the provision of the prisms 171 and 173 that guide the light beams 109 and 111, respectively, renders both of the sensors 37 and 38 arranged on one side of the reject cassette 35-2. That makes the mounting space for the sensors 37 and 38 decreased approximately half as much as the first embodiment, further reducing the size of the entire device. The bill sensor 38, thus including the first prism 171, alone causes the two optical paths 109 to be formed so as to intersect with the moving direction 107 of the accumulation table 164. This can further reduce the number of sensors, thereby reducing costs of the entire device.

The determiner 20 shown in FIG. 2 uses detection results of the accumulation table sensor 37 and the medium sensor 38 to determine whether or not the bills 301 are accumulated on the accumulation table 164 of the reject cassette 35-2. The logical relationship shown in FIG. 14 is applied to the determination logic of the determiner 20 as it is.

Subsequently, a state transition during the accumulation of the bills 301 in the reject cassette 35-2, that is, lowering of the accumulation table 164 will be described with reference to FIGS. 16A, 16B and 16C. Those figures are schematic vertical sectional views specifically showing the state transition during the accumulation of the bills 301 in the reject cassette 35-2. When no bill is accumulated, the accumulation table 164 of the reject cassette 35-2 is raised to its home position by the stage spring 163 as shown in FIG. 15.

Figure 16A:
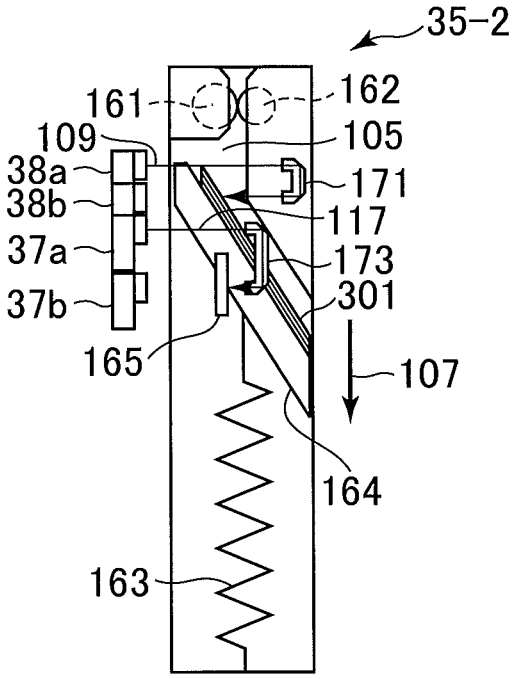
FIGS. 16A, 16B and 16C are schematic vertical sectional views showing a state transition during accumulation of bills in the reject cassette shown in FIG. 15.

Then, as shown in FIG. 16A, when the bills 301 are accumulated on the accumulation table 164, the optical path 109 formed by the bill sensor 38 is blocked by the bills 301. When the accumulation table 164 lowers more or less due to the weight of the accumulated bills 301, and remains above the predetermined position, the optical path 117 formed by the accumulation table sensor 37 is blocked by the stage detector 165. At this time, since the detection results of both accumulation table sensor 37 and bill sensor 38 show "dark", the determiner 20 determines that the bills 301 are accumulated on the accumulation table 164 according to the logical relationship shown in FIG. 14.

Figure 16B:
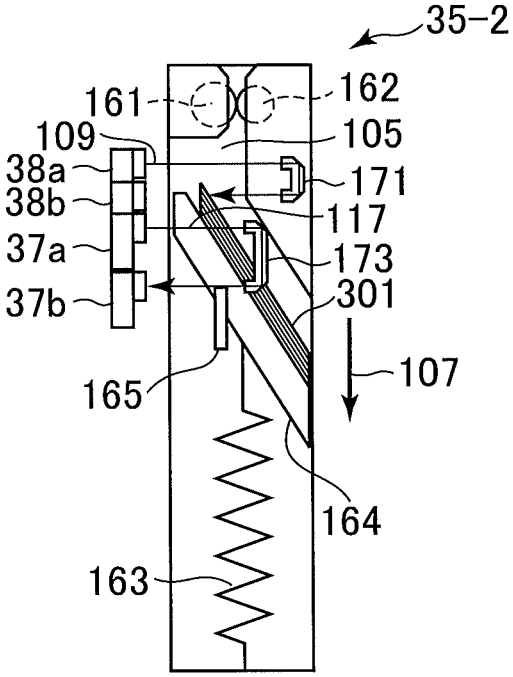

After that, as shown in FIG. 16B, when the bills 301 are further accumulated on the accumulation table 164, the accumulation table 164 lowers due to the weight of the bills 301, and the optical path 117 formed by the accumulation table sensor 37 becomes unblocked by the stage detector 165 provided on the accumulation table 164. However, as shown in the figure, the optical path 109 formed by the bill sensor 38 is still blocked by the bills 301. Thus, the detection results of the accumulation table sensor 37 and the bill sensor 38 show "bright" and "dark", respectively, so that the determiner 20 determines that the bills are accumulated on the accumulation table 164 according to the logical relationship shown in FIG. 14.

Figure 16C:
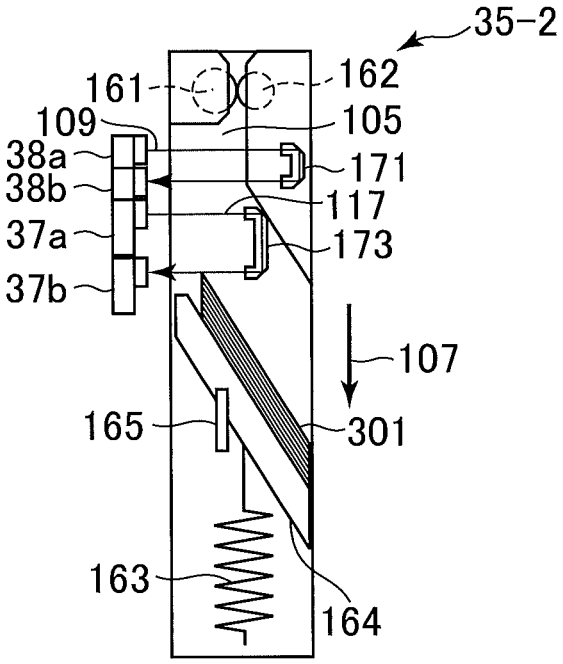

As in the earlier-described embodiment, depending on the weight or thickness of the bills 301, for example, when the bills 301 are wet, as shown in FIG. 16C, the accumulation table 164 may be lowered further from the normal position, and thus the optical path 109 formed by the bill sensor 38 may become not blocked by the bills 301. However, in this case, since the detection results of both accumulation table sensor 37 and bill sensor 38 show "bright", the determiner 20 determines that the bills are accumulated on the accumulation table 164 according to the logical relationship shown in FIG. 14.

Now, when the operator removes all of the bills 301 from the reject cassette 35-2, the bill weight becomes zero, and the accumulation table 164 is raised to the stopper, not shown, by the repulsive force of the stage spring 163 and returns to its home position. At the home position, as shown in FIG. 15, the optical path 117 formed by the accumulation table sensor 37 is blocked by the stage detector 165 whereas the optical path 109 formed by the bill sensor 38 is not blocked by the bills 301. Thus, the detection result of the accumulation table sensor 37 shows "dark", or the detection result of the bill sensor 38 shows "bright", so that the determiner 20 determines that no bill is accumulated on the accumulation table 164 according to the logical relationship shown in FIG. 14.

In summary, in the present embodiment, the provision of the prisms 171 and 173 that guide the optical paths 109 and 117, respectively, allows the sensors 38 and 37 to be arranged in one side of the reject cassette 35-2. That makes the sensor mounting space to be decreased about half as much as the earlier-describe embodiment, enabling further reduction of the device in size.

Although the embodiment shown in FIGS. 15 and 16 has the prisms 171 and 173 that refract or reflect the light beams 105 and 117, respectively, this is merely an example, and the present invention is not limited to such an example. In place of the prisms, other light-guiding members that reflect and guide light, such as reflective plates and optical fibers, may be applied.

In the instant embodiment, the bill sensor 38 may be provide in plural so as to form a plurality of optical paths corresponding to the size of the bills 301 to be sensed. For example, as shown in FIG. 17, the reject cassette 35-2 is provided with two sets of bill sensors 38 to form four optical paths 109.

Figure 17:
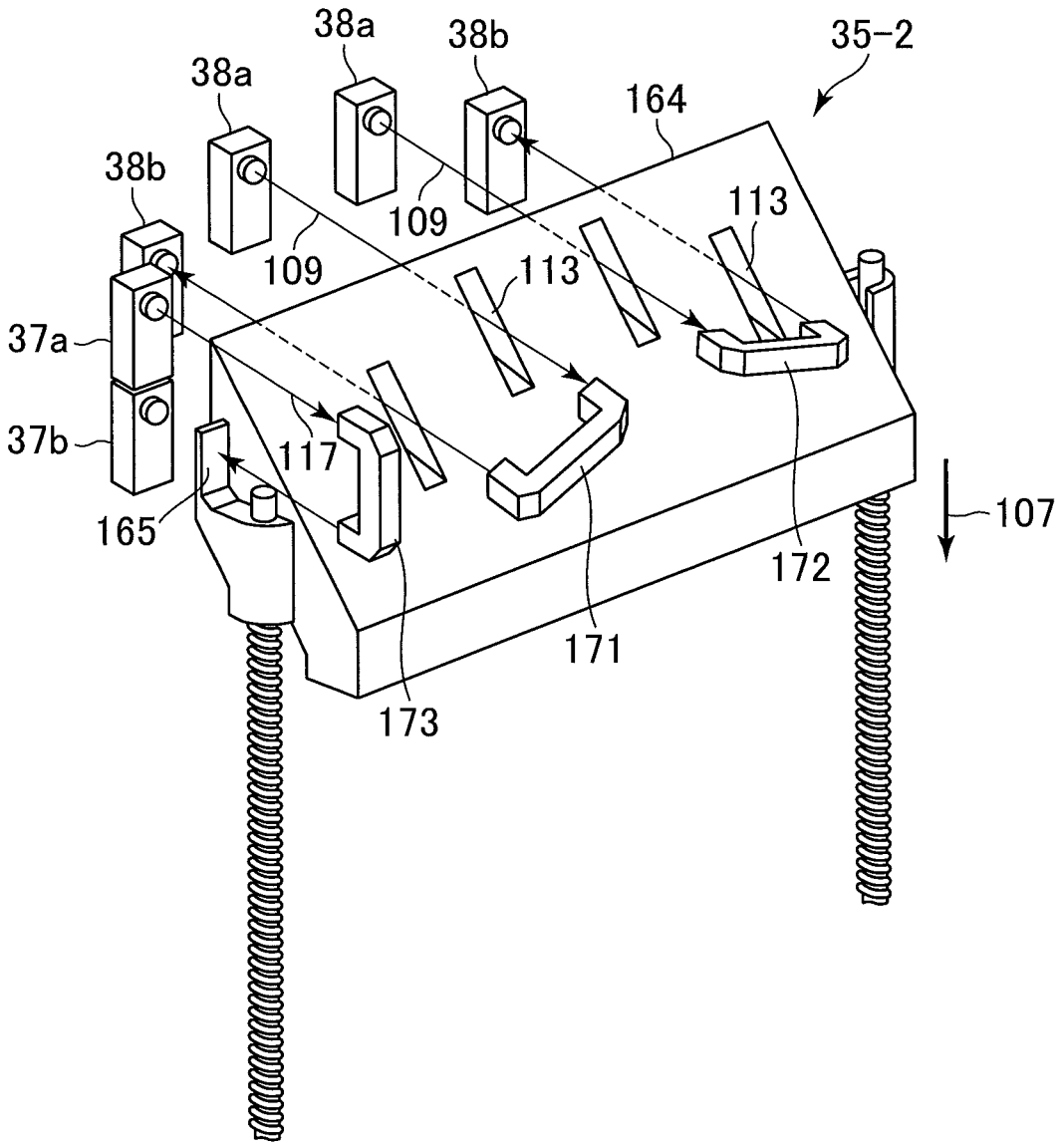
FIG. 17 is a schematic perspective view showing the reject cassette in a case where an additional bill sensor is arranged in the embodiment shown in FIG. 15.
Figure 18:
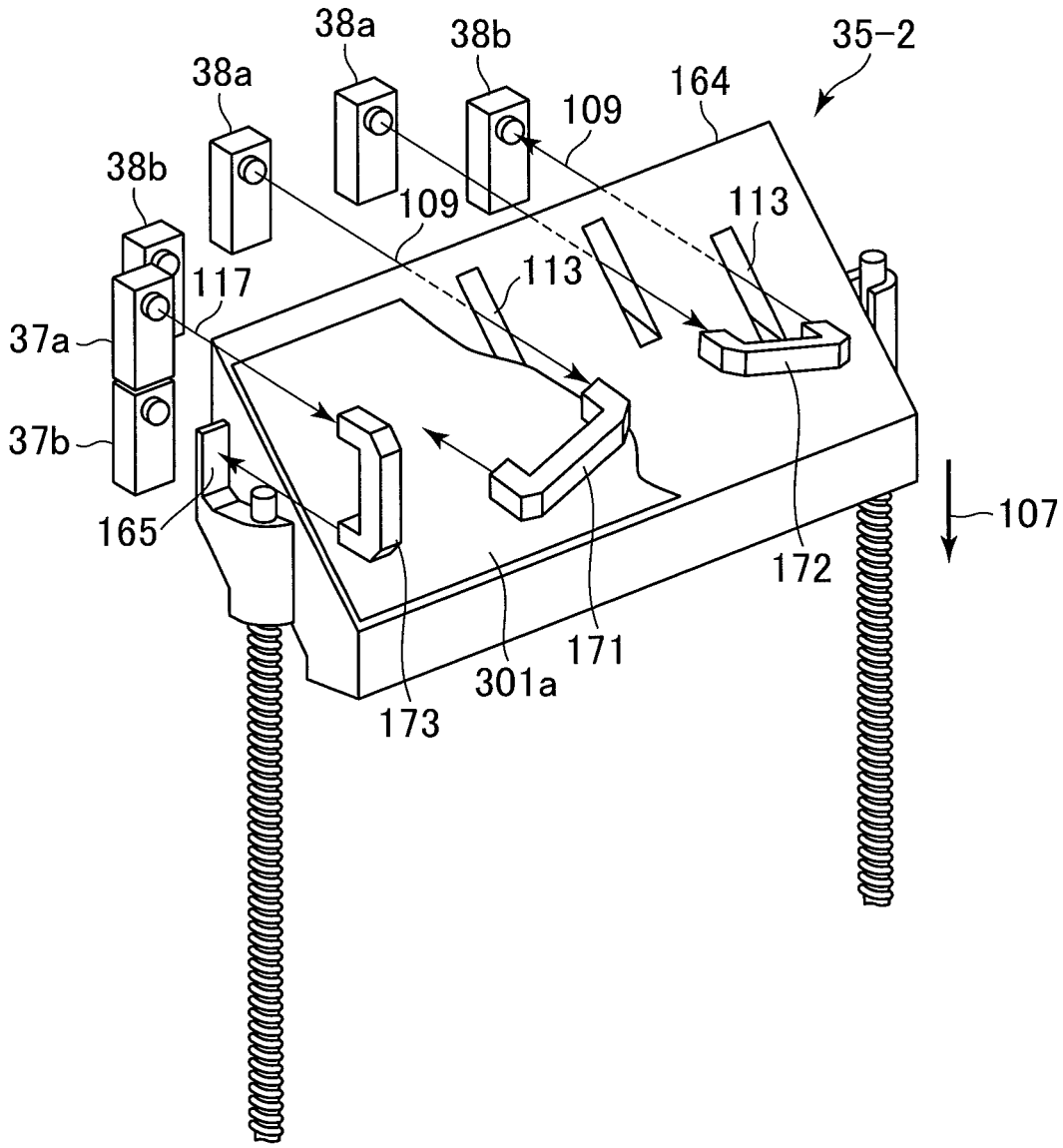
FIG. 18 is a schematic perspective view showing a state where bills are accumulated in the reject cassette shown in FIG. 17.

In the example shown in FIG. 17, the optical paths 109 passing through the accumulation table 164 are provided at heights different from each other. Thus, as shown in FIG. 18, even when a broken or bent bill 301*a* is placed on the accumulation table 164, the bill 301*a* can be sensed once at least one of the optical paths 109 formed by the bill sensor 38 is interrupted.

Figure 19:
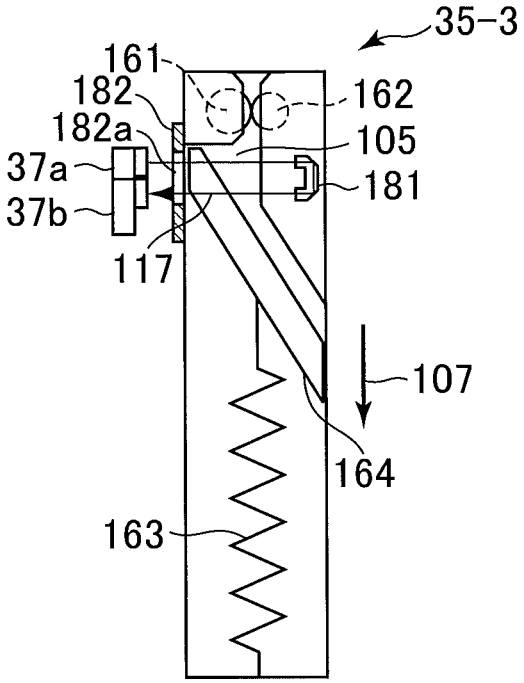
FIG. 19 is a schematic vertical sectional view showing the configuration of a reject cassette in accordance with the third embodiment of the present invention.
Figure 21:
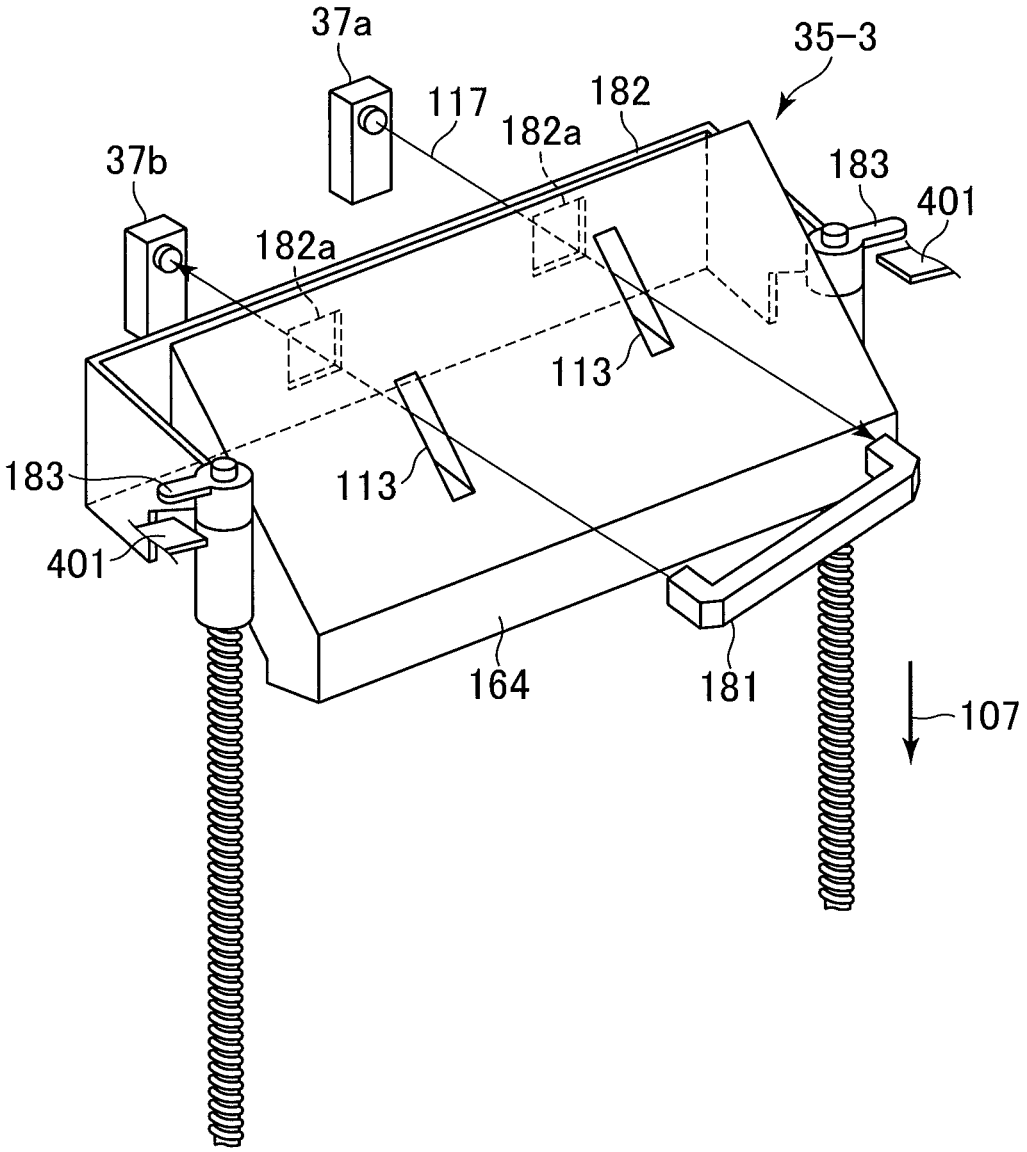
FIG. 21 is a schematic perspective view showing the reject cassette shown in FIG. 19.

FIG. 19 is a schematic vertical sectional view showing the configuration of a reject cassette 35-3 in accordance with a third embodiment of the present invention. FIG. 21 is a schematic perspective view of the reject cassette 35-3 in accordance with this embodiment. As can be seen from FIGS. 19 and 21, the reject cassette 35-3 has a prism 181 in addition to the driving roller 161, the idle roller 162, the stage spring 163 and the accumulation table 164. The driving roller 161, idle roller 162, stage spring 163 and accumulation table 164 may be the same as in the above-mentioned embodiments.

The prism 181 is configured so as to refract the light beam 117 emitted from the light-emitter 37*a* of the accumulation table sensor 37 and guide the latter to the optical sensor 37*b*, and is fixedly provided at a point that does not move with the movement of the accumulation table 164, for example, the housing of the cassette 35-3.

In the instant embodiment, between the reject cassette 35-3 and the accumulation table sensor 37 a shutter 182 is provided. The shutter 182 is generally made of an optically opaque, light-blocking material that blocks the optical path 117, but has its part cut into an optical through hole 182*a* that allows the optical path 117 formed by the accumulation table sensor 37 to pass therethrough.

The shutter 182 is arranged so as to engage with the accumulation table 164 to lift and lower together with the accumulation table 164. The shutter 182 may be configured to lift and lower along a sliding groove, not shown, or rotate about its rotational axis. In any case, as shown in FIG. 21, when the accumulation table 164 is located above the predetermined position, the shutter 182 is raised by the accumulation table 164. In this state, the optical path 117 formed by the accumulation table sensor 37 passes through the hole 182*a* provided in the shutter 182 and a slit 113 provided in the accumulation table 164. When the bills 301 are accumulated on the accumulation table 164, the optical path 117 passing through the hole 182*a* provided in the shutter 182 is blocked by the bills 301. As described above, the accumulation table sensor 37 in the present embodiment also functions as the bill sensor 38.

When the accumulation table 164 lowers due to the self-weight of the accumulated bills 301, the shutter 182 also lowers together with the accumulation table 164 to a position where the shutter blocks the optical path 117, and will cease there. Specifically, as shown in FIG. 21, the shutter 182 is provided with a protrusion 183, and when the shutter 182 lowers together with the accumulation table 164, the protrusion 183 engages with a stopper 401. This prevents further lowering of the shutter 182.

The determiner 20 shown in FIG. 2 uses the detection result of the accumulation table sensor 37 having the above-mentioned configuration to determine whether or not the bills 301 are accumulated on the accumulation table 164 of the reject cassette 35-3. Since the sensor 37 in the instant embodiment is the optical sensor, when the light beam 117 emitted from the light-emitter 37*a* is received by the optical sensor 37*b*, the detection result shows "bright", whereas when the optical path 117 is blocked by the bills 301 or the shutter 182, the detection result shows "dark".

Thus, when the detection result of the accumulation table sensor 37 shows "bright", the determiner 20 determines that no bill 301 is accumulated on the accumulation table 164. That is the case where the accumulation table sensor 37 detects that the accumulation table 164 is located above the predetermined position, or fails to detect the accumulation of the bills 301. In either case, the determiner 20 will determine that no bill is accumulated on the accumulation table 164.

By contrast, when the detection result of the accumulation table sensor 37 shows "dark", the determiner 20 determines that the bills 301 are accumulated on the accumulation table 164. That is the case where the accumulation table sensor 37 detects that the accumulation table 164 lowers below the predetermined position, or senses the bills 301 accumulated. In either case, the determiner 20 will determine that the bills are accumulated on the accumulation table 164.

Figure 20A:
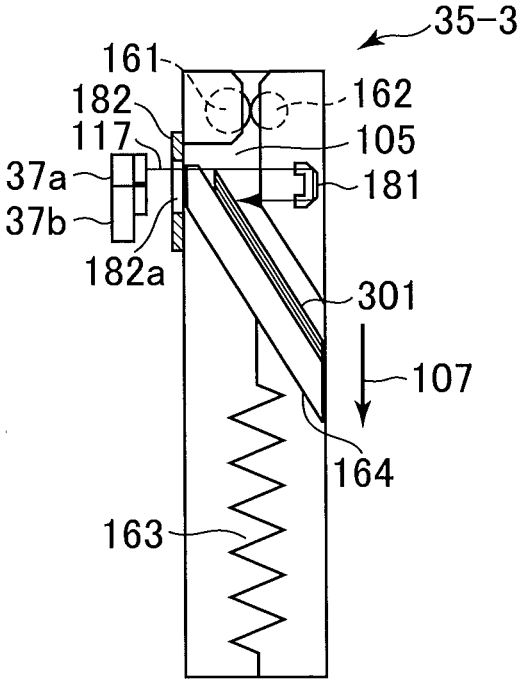
FIGS. 20A, 20B and 20C are schematic vertical sectional views showing a state transition during accumulation of bills in the reject cassette shown in FIG. 19.

Subsequently, a state transition while the bills 301 are accumulated in the reject cassette 35-3 and the cassette 35-3 lowers will be described with reference to FIGS. 20A, 20B and 20C. Those figures are schematic, vertical sectional views specifically showing the state transition during accumulation of the bills 301 in the reject cassette 35-3.

When no bills 301 are accumulated on the accumulation table 164 of the reject cassette 35-3, as shown in FIG. 19, the accumulation table 164 is raised to its home position by the stage spring 163. After that, when the bills 301 are accumulated on the accumulation table 164, as shown in FIG. 20A, the optical path 117 formed by the accumulation table sensor 37 is blocked by the bills 301. At this time, since the accumulation table sensor 37 shows "dark", the determiner 20 determines that bills 301 are accumulated on the accumulation table 164.

Figure 20B:
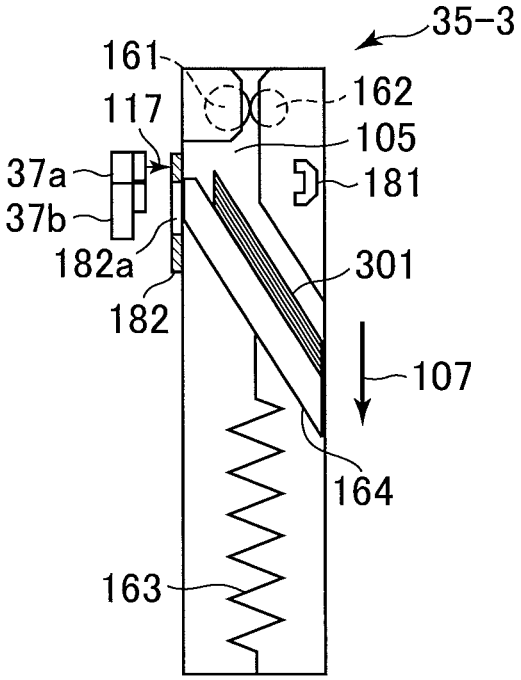

Then, as shown in FIG. 20B, when the bills 301 are further accumulated on the accumulation table 164, the accumulation table 164 lowers due to the weight of the bills 301, and the shutter 182 also lowers together with the accumulation table 164. That causes the optical path 117 formed by the accumulation table sensor 37 to be blocked by the shutter 182. At this time, since the detection result of the accumulation table sensor 37 shows "dark", the determiner 20 determines that bills 301 are accumulated on the accumulation table 164.

Figure 20C:
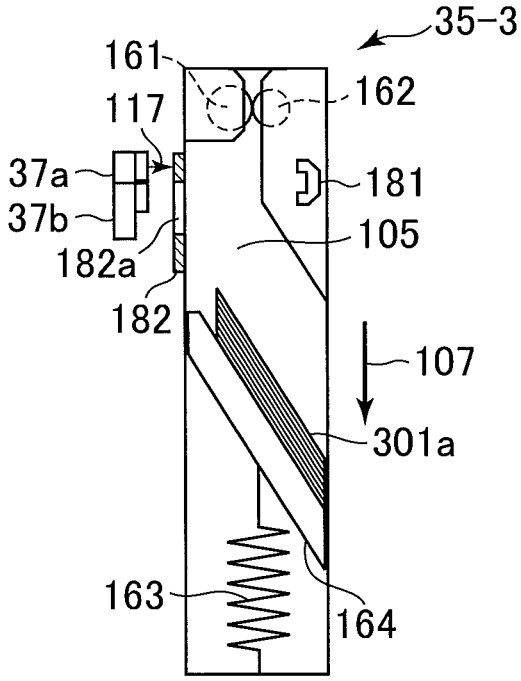

Now, as shown in FIG. 20C, depending on the weight or thickness of the bills 301*a*, for example, when the bills are wet, the accumulation table 164 may further be lowered from the normal position shown in FIG. 20B. In this case, although the shutter 182 also lowers together with the accumulation table 164, the protrusion 183 provided on the shutter 182 engages with the stopper 401 as described above, so that the shutter 182 stops lowering at a height where the shutter 182 blocks the optical path 117 formed by the accumulation table sensor 37. Accordingly, as shown in FIG. 20C, the optical path 117 formed by the accumulation table sensor 37 is blocked by the shutter 182. At this time, since the accumulation table sensor 37 shows "dark", the determiner 20 determines that bills 301*a* are accumulated on the accumulation table 164.

Then, when the operator entirely removes the bills 301 from the reject cassette 35-3, the bill weight becomes zero, and the accumulation table 164 is raised to its home position by the stage spring 163 again. At the home position, as shown in FIG. 19, the optical path 117 formed by the accumulation table sensor 37 is not blocked. At this time, since the detection result of the accumulation table sensor 37 shows "bright", the determiner 20 determines that no bill 301 is accumulated on the accumulation table 164.

In summary, in the instant embodiment, the shutter 182 working with the accumulation table 164 is arranged. That allows the single optical sensor 37 to be used to more correctly determine whether or not the bills 301 are accumulated. Thus, the number of the sensors is reduced, enabling the interconnections and the size of circuit boards to be reduced, thereby implementing a device entirely reduced in size and cost.

In the first and second embodiments described earlier, when the detection result of the accumulation table sensor 37 shows "dark", the determiner 20 determines that the accumulation table 164 is located above the predetermined position. However, the present invention is not limited to those specific embodiments. For example, depending on the configuration of the reject cassette 35, the determiner 20 may determine that the accumulation table 164 is located above the predetermined position when the detection result of the accumulation table sensor 37 shows "bright". Thus, a fourth embodiment will be shown in FIG. 22, in which the prism 191 may be attached to the accumulation table 164 so that the determiner 20 determines that the accumulation table 164 is located above the predetermined position when the detection result of the accumulation table sensor 37 shows "bright".

Figure 22:
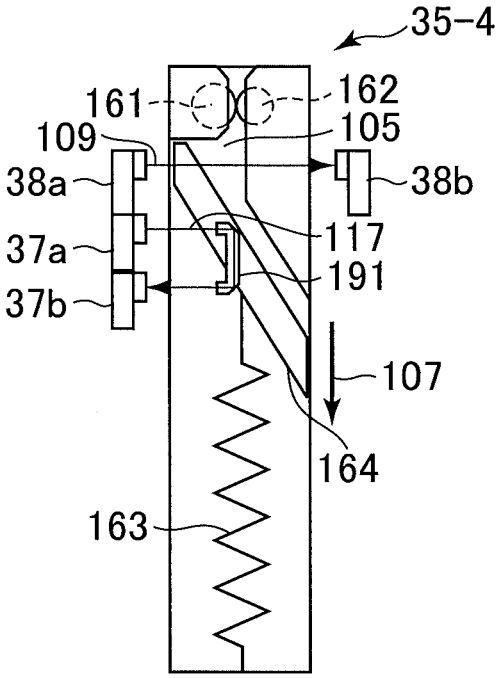
FIG. 22 is a schematic vertical sectional view showing the configuration of a reject cassette in accordance with the fourth embodiment of the present invention.

Referring to FIG. 22, a reject cassette 35-4 in accordance with the fourth embodiment has a prism 191 in addition to the driving roller 161, the idle roller 162, the stage spring 163 and the accumulation table 164. The driving roller 161, idle roller 162, stage spring 163 and accumulation table 164 may be the same as in the above-mentioned embodiments.

The prism 191 refracts the light beam 117 emitted from the light-emitter 37*a* of the accumulation table sensor 37 to guide the latter to the optical sensor 37*b*. The prism 191 is attached to the accumulation table 164 so as to move with the movement of the accumulation table 164 at a position where the prism 191 guides the light beam 117 emitted from the light-emitter 37*a* to the optical sensor 37*b* when the accumulation table 164 is located above the predetermined position.

Since the sensor 37 in accordance with the fourth embodiment is an optical sensor, when the light beam 117 emitted from the light-emitter 37*a* is received by the optical sensor 37*b*, the detection result of the sensor 37 shows "bright", whereas when the light beam 117 is not received, the detection result of the sensor 37 shows "dark". Thus, in the reject cassette 35-4 in accordance with the fourth embodiment, when the accumulation table 164 is located above the predetermined position, the prism 191 guides the light beam 117 emitted from the light-emitter 37*a* to the optical sensor 37*b*, so that the detection result of the accumulation table sensor 37 shows "bright". The detection result of the accumulation table sensor 37 thus showing "bright" causes the determiner 20 to determine that the accumulation table 164 is located above the predetermined position.

While the present invention has been described with reference to the particular illustrative embodiments, it is not to be restricted by the embodiments. It is to be appreciated that those skilled in the art can change or modify the embodiments without departing from the scope and spirit of the present invention.

For example, in the above-described embodiments, the optical sensors are used as the accumulation table sensor 37 and the bill sensor 38. However, the present invention is not limited to this example. In place of or in addition to the optical sensors, sensors relying upon other operating principles, such as contact sensors or magnetic sensors, may be used as the accumulation table sensor 37 and the bill sensor 38.

Although one set of bill sensors 38 are provided in the embodiments, the present invention is not limited to this example. For example, a required number of bill sensors, for example, two or three sets of bill sensors, may be arranged according to the size and shape of target bills.

Although the sensors are arranged outside of the reject cassette in the embodiments, such sensors may be provided within the reject cassette.

In the embodiments, the accumulation table 164 has the inclined surface, on which bills are accumulated in the inclined position. However, the present invention is not limited to this example. For example, the accumulation surface may be formed horizontal, on which bills may be vertically accumulated in the horizontal position. Also in this case, the accumulation table being lowered can be sensed to determine whether or not bills are accumulated on the accumulation table.

The entire disclosure of Japanese patent application No. 2010-189233 filed on Aug. 26, 2010, including the specification, claims, accompanying drawings and abstract of the disclosure, is incorporated herein by reference in its entirety.

The invention claimed is:

1. A medium accumulating device comprising:

an accumulation table for accumulating media;

an accumulation table detector detecting a lowering of said accumulation table, said accumulation table detector detecting whether or not said accumulation table lowers below a predetermined position in an upper part of a lifting and lowering range of the accumulation table; and a medium detector detecting whether or not at least one medium of the media is accumulated on said accumulation table when said accumulation table is located above the predetermined position, said accumulation table detector including a first set that includes a light-emitter and an optical sensor that form a first optical path in a direction intersecting a lifting and lowering direction of said accumulation table, said medium detector including a second set that includes a light-emitter and an optical sensor that form a second optical path in the direction intersecting the lifting and lowering direction of said accumulation table.

2. The medium accumulating device in accordance with claim 1, wherein an elastic member movably supports said accumulation table in an accumulating direction of the media.

3. The medium accumulating device in accordance with claim 1, wherein said accumulation table has a surface inclined with respect to the lifting and lowering direction of said accumulation table.

4. The medium accumulating device in accordance with claim 1, wherein the medium detector detects the at least one medium of the media when the at least one medium is the only medium on the accumulation table.

5. The medium accumulating device in accordance with claim 1, further comprising a determiner using a detection result of said accumulation table detector and a detection result of said medium detector to determine whether or not the media is accumulated on said accumulation table.

6. The medium accumulating device in accordance with claim 5, wherein said determiner determines that the media is accumulated on said accumulation table when said accumulation table lowers below the predetermined position, or the at least one medium is detected as being accumulated on said accumulation table based upon the detection result of the medium detector.

7. The medium accumulating device in accordance with claim 5, wherein said determiner determines that no medium is accumulated on the accumulation table when both of said accumulation table is located above the predetermined position, and the media is detected as not accumulated on said accumulation table based upon the detection result of the medium detector.

8. The medium accumulating device in accordance with claim 1, wherein said accumulation table includes a light-blocking member blocking the first optical path when said accumulation table is located above the predetermined position.

9. The medium accumulating device in accordance with claim 1, wherein both of said accumulation table detector and said medium detector are provided on a same one side with respect to said accumulation table, said device further comprising:

a first light-guiding member guiding the first optical path to the optical sensor of said first set; and a second light-guiding member guiding the second optical path to the optical sensor of said second set.

10. The medium accumulating device in accordance with claim 9, wherein said first and second light-guiding members each include an optical prism.

11. The medium accumulating device in accordance with claim 1, wherein said accumulation table includes a light-guiding member guiding the first optical path to the optical sensor of said first set when said accumulation table is located above the predetermined position.

12. The medium accumulating device in accordance with claim 11, wherein said light-guiding member includes an optical prism.

13. The medium accumulating device in accordance with claim 1, said device further comprising a light-blocking member lowering to a position where said light-blocking member blocks the first optical path as said accumulation table lowers.

14. The medium accumulating device in accordance with claim 13, further comprising a determiner using a detection result of said accumulation table detector to determine whether or not the medium is accumulated on said accumulation table.

15. The medium accumulating device in accordance with claim 13, wherein said accumulation table detector detects whether or not the optical path passes a medium accumulating area of said accumulation table and the media is accumulated on said accumulation table.

16. A medium accumulating device comprising:

an accumulation table having a surface for supporting accumulated media;

an elastic member movably supporting said accumulation table in an accumulating direction of the media;

an accumulation table detector detecting lowering of said accumulation table, said accumulation table detector detecting whether or not said accumulation table lowers below a predetermined position, said accumulation table detector including a first set of a light-emitter and an optical sensor that form a first optical path in a direction intersecting a lifting and lowering direction of said accumulation table; and a medium detector for detecting whether or not the media is accumulated on said accumulation table when said accumulation table is located above the predetermined position, said medium detector including a second set of a light-emitter and an optical sensor that form a second optical path in the direction intersecting the lifting and lowering direction of said accumulation table.

* * * * *